US010131070B2

(12) United States Patent
Nonaka et al.

(10) Patent No.: US 10,131,070 B2
(45) Date of Patent: Nov. 20, 2018

(54) SHEET PUNCHING DEVICE AND IMAGE FORMING APPARATUS

(71) Applicant: CANON FINETECH NISCA INC., Saitama-ken (JP)

(72) Inventors: Masato Nonaka, Moriya (JP); Isao Itagaki, Abiko (JP)

(73) Assignee: Canon Finetech Nisca Inc., Misato-shi (JP)

( * ) Notice: Subject to any disclaimer, the term of this patent is extended or adjusted under 35 U.S.C. 154(b) by 343 days.

(21) Appl. No.: 13/664,937

(22) Filed: Oct. 31, 2012

(65) Prior Publication Data

US 2013/0114984 A1 May 9, 2013

(30) Foreign Application Priority Data

Nov. 9, 2011 (JP) ..... 2011-245995
Aug. 28, 2012 (JP) ..... 2012-187785

(51) Int. Cl.

| | |
|---|---|
| ***B26F 1/06*** | (2006.01) |
| ***B26F 1/14*** | (2006.01) |
| ***G03G 15/00*** | (2006.01) |
| *B26D 5/16* | (2006.01) |
| *B26D 7/18* | (2006.01) |
| *B26F 1/00* | (2006.01) |
| *B26F 1/12* | (2006.01) |

(52) U.S. Cl.

CPC ..... *B26F 1/06* (2013.01); *B26F 1/14* (2013.01); *G03G 15/6582* (2013.01); *B26D 5/16* (2013.01); *B26D 7/1818* (2013.01); *B26F 1/0092* (2013.01); *B26F 1/12* (2013.01); *G03G 2215/00818* (2013.01); *Y10T 83/215* (2015.04); *Y10T 83/8843* (2015.04); *Y10T 83/9425* (2015.04)

(58) Field of Classification Search

CPC .. B26F 1/06; B26F 1/0092; B26F 1/08; B26F 1/10; B26D 5/16; Y10T 83/4746; Y10T 83/4749; Y10T 83/4751; Y10T 83/4754; Y10T 83/4757; Y10T 83/476; Y10T 83/4763

USPC ..... 83/667, 663, 669, 314, 317, 337, 343, 83/345, 660, 659

See application file for complete search history.

(56) References Cited

U.S. PATENT DOCUMENTS 1,306,009 A * 6/1919 Hartman ..... 83/337
1,910,395 A * 5/1933 Kreis ..... 83/310
(Continued)

FOREIGN PATENT DOCUMENTS

DE 4025518 C1 * 1/1992 ..... B26F 1/10
EP 2522472 A1 * 11/2012
(Continued)

OTHER PUBLICATIONS

Office Action dated Nov. 19, 2013, in Japanese Patent Application No. 2012-187785.

*Primary Examiner* — Jennifer Swinney
(74) *Attorney, Agent, or Firm* — Fitzpatrick, Cella, Harper & Scinto

(57) ABSTRACT

A sheet punching device including: a die which has a die hole and is configured to be driven to rotate; a punch configured to move in and out of the die hole to punch a hole in a sheet; and a punch operating unit configured to reciprocate the punch with respect to the die hole in a state in which the punch is opposed to the die hole of the die, to move the punch in and out of the die hole.

11 Claims, 21 Drawing Sheets

(56) References Cited

U.S. PATENT DOCUMENTS

| | | | | | |
|---|---|---|---|---|---|
| 2,083,370 | A | * | 6/1937 | Greulich | 83/337 |
| 2,202,889 | A | * | 6/1940 | Bates | B41F 17/10 242/525.4 |
| 3,916,744 | A | * | 11/1975 | West | 83/175 |
| 3,958,476 | A | * | 5/1976 | Bartha | B21D 28/24 83/143 |
| 5,317,942 | A | * | 6/1994 | Nakajima | 83/50 |
| 6,386,080 | B1 | * | 5/2002 | Okamoto | B26D 5/32 83/289 |
| 6,907,806 | B1 | * | 6/2005 | Okamoto et al. | 83/76.8 |
| 7,392,983 | B2 | | 7/2008 | Kodama et al. | |

FOREIGN PATENT DOCUMENTS

| | | | | |
|---|---|---|---|---|
| JP | 01062226 | A | * | 3/1989 |
| JP | 03216223 | A | * | 9/1991 |
| JP | 05269530 | A | * | 10/1993 |
| JP | H0970799 | A | | 3/1997 |
| JP | 2001-026370 | A | | 1/2001 |
| JP | 2001-179690 | A | | 7/2001 |
| JP | 2009-066723 | A | | 4/2009 |
| JP | 2011-121135 | A | | 6/2011 |

* cited by examiner

SHEET PUNCHING DEVICE AND IMAGE FORMING APPARATUS

BACKGROUND OF THE INVENTION

Field of the Invention

The present invention relates to a sheet punching device configured to punch a hole in a sheet, and an image forming apparatus including the sheet punching device in a main body of the apparatus.

Description of the Related Art

Conventionally, some image forming apparatus configured to form an image on a sheet include a sheet punching device configured to punch a hole in the sheet in a main body of the apparatus.

The sheet punching device includes a rotary type sheet punching device which punches a hole in a sheet by rotating a die and a punch at the same time (see Japanese Patent Application Laid-Open No. 2001-179690) and a press punch type sheet punching device which includes a punch and a die arranged opposite to each other while interposing a sheet therebetween and moves the punch in a direction perpendicular to the sheet to punch a hole in the sheet (see Japanese Patent Application Laid-Open No. 2001-26370).

However, the rotary type sheet punching device and the press punch type sheet punching device have the following features and problems.

That is, the rotary type sheet punching device punches a hole in the sheet by rotating the die and the punch at the same time, and hence it is possible to punch a hole in the sheet while keeping on conveying the sheet, thus providing a feature of high punching efficiency. However, the die and the punch are engaged with each other while being rotated, and hence a tip portion of the punch and an entrance portion of a die hole of the die need to be formed normally into involute curve shapes as in an engagement of gears. When the tip portion of the punch and the entrance portion of the die hole are formed into the involute curve shapes, a clearance is generated therebetween, and hence it is difficult to punch the hole with accuracy.

On the other hand, the press punch type sheet punching device punches a hole in the sheet by moving the punch in the direction perpendicular to the sheet, thus providing a feature that a hole of an accurate shape can be punched in the sheet. However, the press punch type sheet punching device cannot punch the hole without temporarily stopping the sheet which is being conveyed, thereby posing a problem of low punching efficiency.

Therefore, there has been a demand for a sheet punching device which takes advantage of the features of both types of sheet punching devices while solving the problems inherent therein.

SUMMARY OF THE INVENTION

The present invention provides a sheet punching device which punches a hole in a sheet with accuracy and efficiency and enables a punch and a die to be used for a long period of time, and an image forming apparatus including the sheet punching device.

According to an exemplary embodiment of the present invention, there is provided a sheet punching device, including: a die which has a die hole and is configured to be driven to rotate; a punch configured to move in and out of the die hole to punch a hole in a sheet; and a punch operating unit configured to reciprocate the punch with respect to the die hole in a state in which the punch is opposed to the die hole of the die, to move the punch in and out of the die hole.

The sheet punching device according to the exemplary embodiment is configured to move the punch in and out of the die hole in a state in which the punch is opposed to the die hole with respect to the rotating die. Therefore, the sheet punching device punches a hole with accuracy and efficiency without stopping conveyance of a sheet.

Further features of the present invention will become apparent from the following description of exemplary embodiments with reference to the attached drawings.

BRIEF DESCRIPTION OF THE DRAWINGS

FIG. 8A illustrates an engaged state of the protrusion and the portion to be engaged. FIG. 8B illustrates a state in which the engaged state of the protrusion and the portion to be engaged is released.

FIG. 12A illustrates a state before punching a hole in a sheet. FIG. 12B illustrates a state in which the hole is being punched in the sheet. FIG. 12C illustrates a state after punching the hole in the sheet.

FIG. 13A illustrates a state before punching the hole in the sheet. FIG. 13B illustrates a state in which the hole is being punched in the sheet. FIG. 13C illustrates a state in which the sheet is separated from the punch.

FIG. 15A illustrates a state in which chad is generated by an operation of punching a hole in the sheet by the punch. FIG. 15B illustrates a state in which the chad is discharged.

FIG. 16A illustrates a state in which chad is generated by an operation of punching a hole in the sheet by the punch. FIG. 16B illustrates a state in which the chad is discharged.

FIG. 17A is a plan view of the die. FIG. 17B illustrates a state in which the punch proceeds into the die. FIG. 17C illustrates a shape of the hole punched in the sheet by the die illustrated in FIG. 17A.

FIG. 19A is an outer appearance perspective view thereof. FIG. 19B is a cross-sectional view thereof taken along an arrow XIXB-XIXB of FIG. 19A.

FIG. 20A is a plan view of the die. FIG. 20B illustrates a state in which the punch proceeds into the die. FIG. 20C illustrates a shape of the hole punched in the sheet by the die illustrated in FIG. 20A.

FIG. 21A is an outer appearance perspective view thereof. FIG. 21B is a cross-sectional view thereof taken along an arrow XXIB-XXIB of FIG. 21A.

DESCRIPTION OF THE EMBODIMENTS

A sheet punching device and an image forming apparatus according to an embodiment of the present invention will be described below with reference to the accompanying drawings.

(Image Forming Apparatus)

Figure 1:
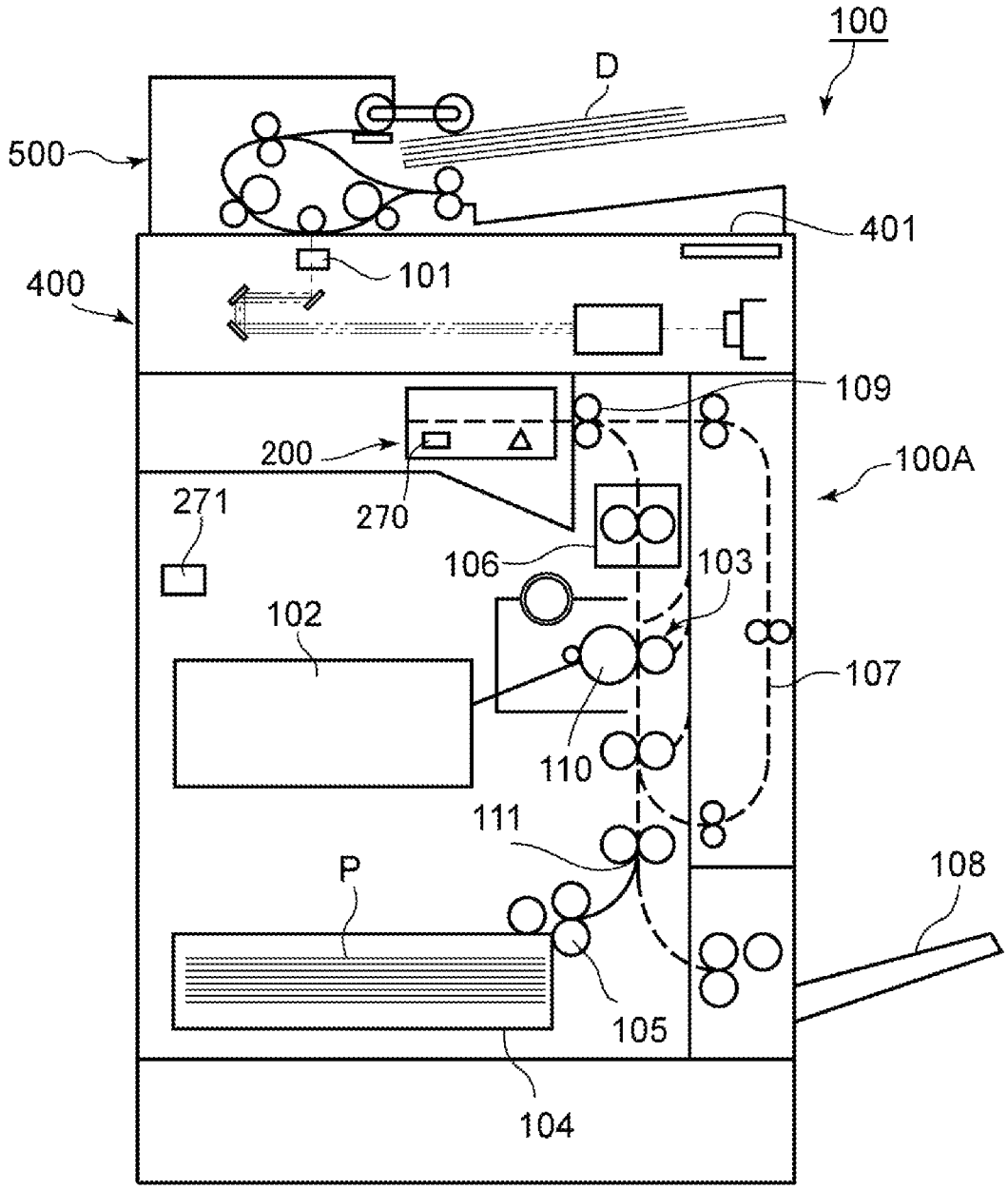
FIG. 1 is a schematic cross-sectional view of an image forming apparatus according to an embodiment of the present invention taken along a sheet conveying direction.

FIG. 1 is a schematic cross-sectional view of an image forming apparatus 100 taken along a sheet conveying direction.

The image forming apparatus 100 includes a main body (hereinafter referred to as an apparatus main body) 100A and a sheet punching device 200. The sheet punching device 200 is configured to punch a hole in a sheet conveyed from the apparatus main body 100A without stopping the conveyance of the sheet.

On an upper portion of the apparatus main body 100A of the image forming apparatus 100, an image reading device 400 and an original feeding device 500 are provided on top of each other. The original feeding device 500 is configured to automatically feed an original D to an upper portion of an original reading portion of the image reading device 400 and then automatically discharges the original D. The image reading device 400 optically reads originals automatically fed by the original feeding device 500 in a sequential manner, and sends image information of the originals to a laser scanner 102 as a digital signal.

The apparatus main body 100A is configured to copy the original onto a sheet such as a plain paper or an OHP sheet based on the image information from the image reading device 400. The apparatus main body 100A is further configured to form an image on the sheet based on image information sent from an external facsimile or personal computer. The image reading device 400 can also read an original placed on a platen glass 401 by a user, and hence the original feeding device 500 is not necessarily provided.

In a lower portion of the apparatus main body 100A of the image forming apparatus 100, a plurality of sheet cassettes 104 (only one sheet cassette is illustrated and the others are omitted in FIG. 1) in which sheets P of various sizes are contained is mounted. A sheet conveyed by conveying rollers 105 from the sheet cassette 104 is fed to a photosensitive drum 110 of an image forming portion 103. The photosensitive drum 110 is irradiated with a laser from the laser scanner 102 so that a latent image is formed thereon. The latent image is developed into a toner image so that the toner image is formed in advance on the photosensitive drum 110. The toner image is then transferred onto the sheet and is fixed to the sheet by a fixing portion 106.

When an image is formed on one side of the sheet and there is no need for forming images on both sides, the sheet is sent to the sheet punching device 200 by a pair of discharge rollers 109. On the other hand, when there is a need for forming images on both sides, the sheet is reversed by switchback conveyance, conveyed along a re-feed path 107, and sent to the image forming portion 103 again. A toner image is transferred onto the other side of the sheet at the image forming portion 103, and the toner image is fixed onto the sheet by the fixing portion 106. Then, the sheet is sent to the sheet punching device 200 by the pair of discharge rollers 109.

The sheet can be fed not only from the sheet cassette 104 but also from a multipurpose tray 108.

The sheet punching device 200 is configured to punch a hole in the sheet that is being conveyed from the pair of discharge rollers 109 without stopping the conveyance of the sheet. Further, the sheet punching device 200 may punch a hole in a sheet before the image forming portion 103 forms the image on the sheet, and therefore may be disposed in the sheet cassette 104. Moreover, the sheet punching device 200 may be disposed slightly downstream of a converging point 111 of a path configured to guide a sheet from the sheet cassette 104 and a path configured to guide a sheet from the multipurpose tray 108. Therefore, a mounting position of the sheet punching device 200 is not limited to the vicinity of the pair of discharge rollers 109 of the apparatus main body 100A described in the embodiment of the present invention.

(Sheet Punching Device)

The sheet punching device according to the embodiment of the present invention will be described below with reference to FIGS. 2 to 14.

A configuration of the sheet punching device will be described.

Figure 2:
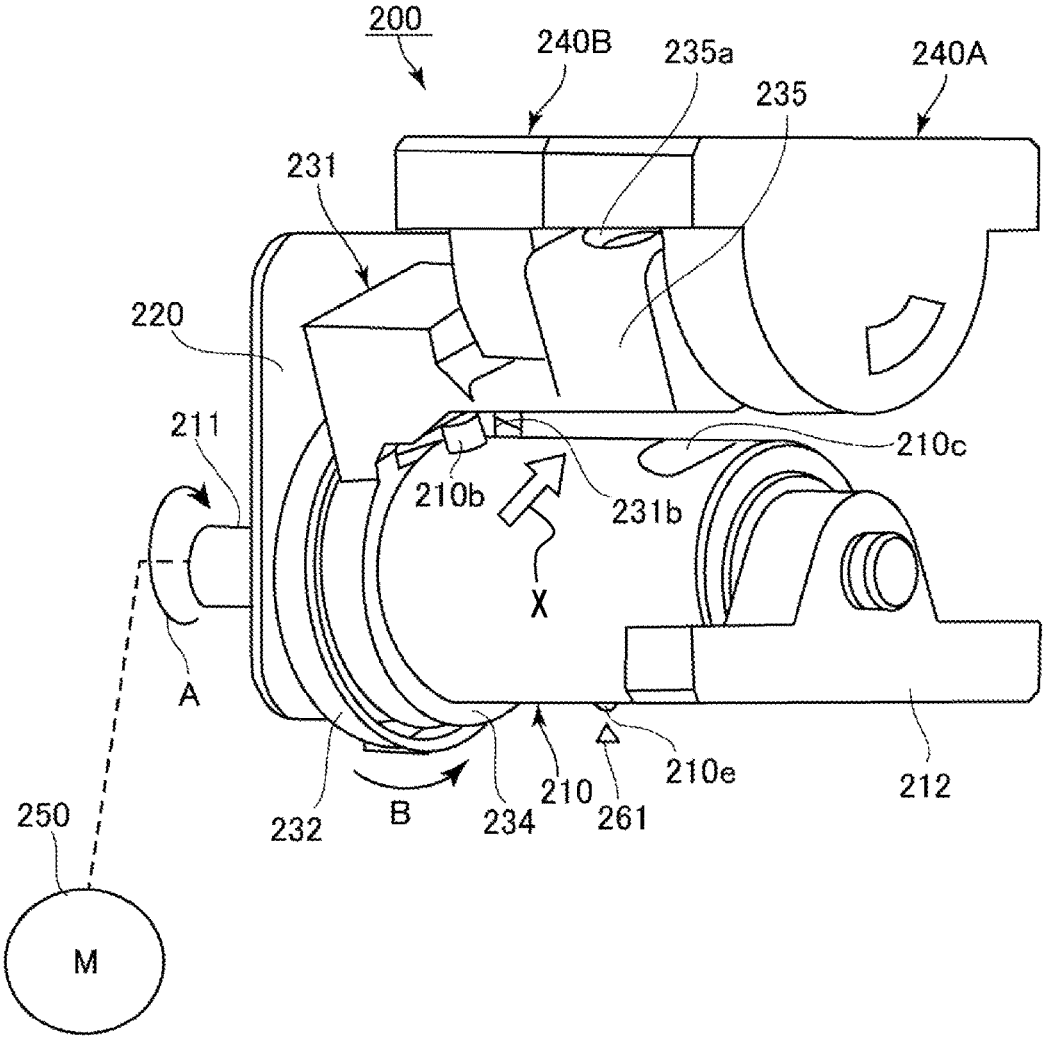
FIG. 2 is an external perspective view of a sheet punching device according to the embodiment of the present invention.
Figure 7:
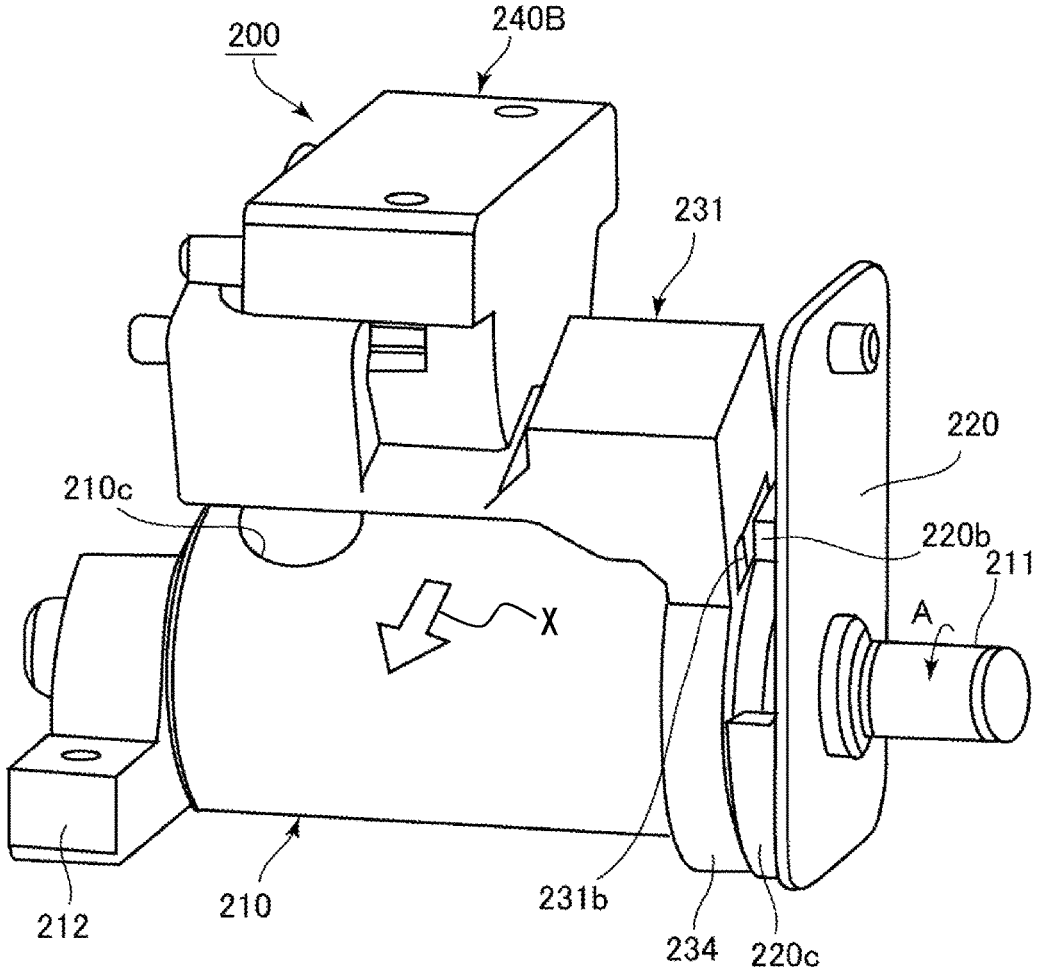
FIG. 7 is an external perspective view of the sheet punching device illustrated in FIG. 2 as viewed from a rear side thereof, from which one punch cam is omitted.

The sheet is conveyed in the sheet conveying direction indicated by an arrow X in FIGS. 2 and 7.

Figure 3:
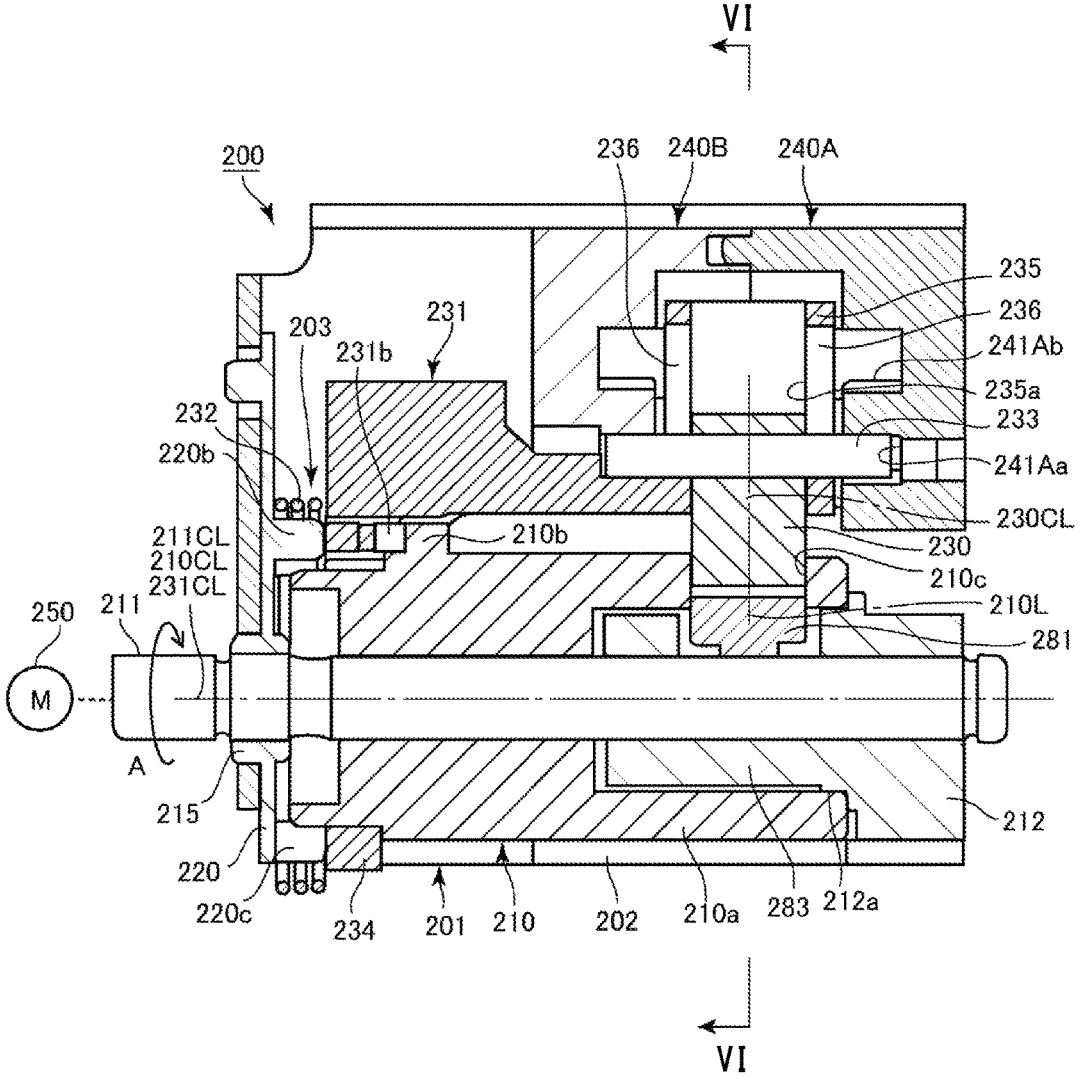
FIG. 3 is a schematic cross-sectional view of the sheet punching device illustrated in FIG. 2 taken along a rotation shaft.

As illustrated in FIG. 3, a frame 201 of the sheet punching device 200 includes a bottom plate 202, a bearing plate 220 provided on one end of the bottom plate 202, and a rotational bearing 212 provided on the other end of the bottom plate 202. A rotational bearing 215 formed in the bearing plate 220 and the rotational bearing 212 formed on the bottom plate 202 rotatably support a rotation shaft 211. The rotation shaft 211 is configured to rotate in a direction indicated by the arrow A in FIG. 3 by a punch motor 250.

As illustrated in FIG. 3, a die 210 of a columnar shape is integrally provided on the rotation shaft 211 in a state in which rotation axes are matched with each other. Therefore, the rotation shaft 211 is configured to drive the die 210 to rotate in the direction indicated by the arrow A in FIG. 3 by the punch motor 250. A cylindrical portion 210*a* is formed on one end of the die 210 (the right end in FIG. 3). The cylindrical portion 210*a* is fitted onto and supported by a die supporting portion 212*a* of a circular shape formed on the rotational bearing 212 (see FIG. 4). One die hole 210*c* is formed in the cylindrical portion 210*a* toward a rotation axis 210CL of the die 210 so as to penetrate through the wall thickness of the cylindrical portion 210*a*.

As illustrated in FIG. 3, on an outer circumference of the die 210, a punch holder 231 (see FIG. 5) as a punch holding member is disposed so as to freely rotate in a reciprocating manner by a ring portion 234 (see FIG. 2). The punch holder 231 is disposed on the die 210 so as to freely rotate in a reciprocating manner in such a manner that a punch 230 is disposed in a punch guide portion 235 (see FIGS. 3 and 5) toward a rotation axis 211CL of the rotation shaft 211, and the rotation axis 211CL of the rotation shaft 211 and a rotation axis 231CL of the punch holder 231 are matched with each other. The punch 230 is disposed in the punch guide portion 235 and directed toward the rotation axis 211CL of the rotation shaft 211. The punch guide portion 235 is directed toward the rotation axis 231CL of the punch holder 231. Therefore, a punch guide hole 235*a* is formed to guide the punch 230 so that the punch 230 moves in and out of the die hole 210*c* by reciprocating the punch 230 with respect to the die hole 210*c*.

The rotation axis 211CL of the rotation shaft 211, the rotation axis 210CL of the die 210, and the rotation axis 231CL of the punch holder 231 are a common rotation axis.

An elastic force of a coil spring 232 (see FIGS. 2 and 3) is applied to the punch holder 231 in a direction along which the punch holder 231 returns to an initial position described later (a direction indicated by an arrow B opposite to the direction indicated by the arrow A). One end 232*a* of the coil spring 232 (see FIG. 6) is engaged with the punch holder 231, and the other end (not shown) of the coil spring 232 is engaged with the bearing plate 220.

Figure 8A:
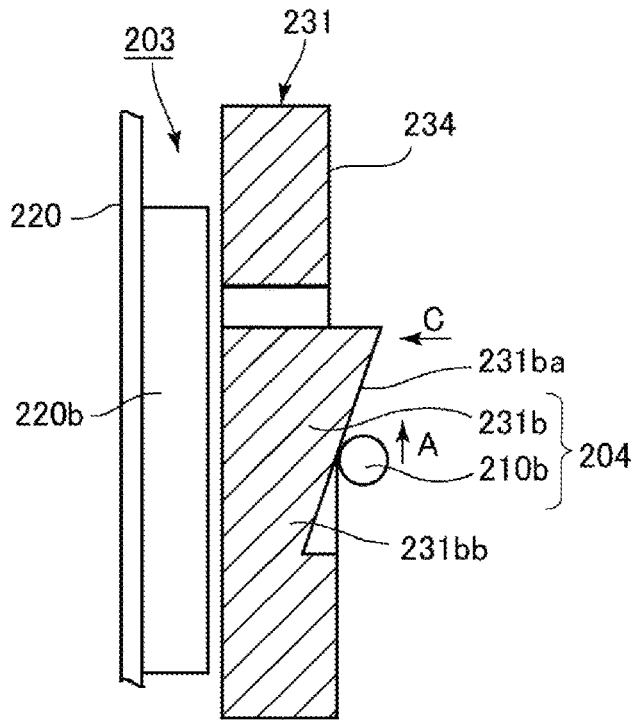
FIGS. 8A and 8B are cross-sectional views of a protrusion as a disengaging portion and a portion to be engaged, for illustrating an operation of the protrusion and the portion to be engaged.
Figure 8B:
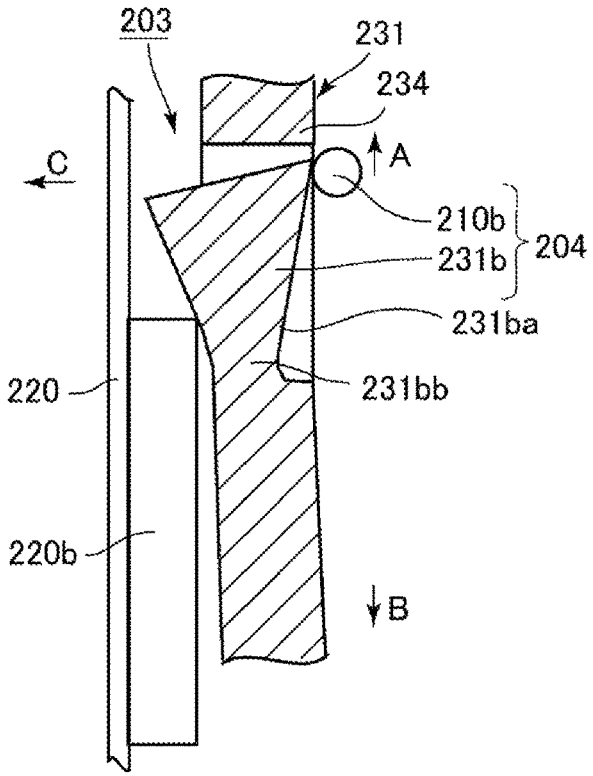
Figure 9:
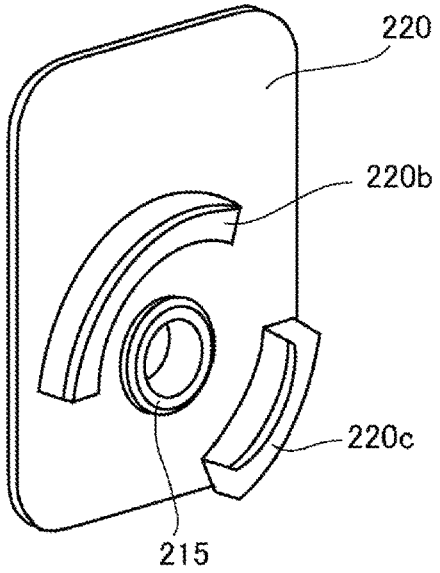
FIG. 9 is a perspective view of an engagement maintaining protruded thread.

On the outer circumference of the die 210, a protrusion 210*b* (see FIGS. 2 and 3) is provided in a protruding manner. A portion to be engaged 231*b* (see FIGS. 2, 3, 7, 8A, and 8B) which abuts against the protrusion 210*b* is formed on the ring portion 234 of the punch holder 231. As illustrated in FIGS. 8A and 8B, the portion to be engaged 231*b* is formed in a portion of the ring portion 234 of the punch holder 231 to be deflected in a wall thickness direction of the ring portion 234 (a direction indicated by an arrow C). The portion to be engaged 231*b* has an inclined surface 231*ba* protruding from a side surface of the ring portion 234 to a position at which the portion to be engaged 231*b* abuts against the protrusion 210*b*. Further, the portion to be engaged 231*b* is formed in such a manner that a wall thickness of a base portion 231*bb* is smaller than that of the ring portion 234 so that the portion to be engaged 231*b* is easily deflected in the direction indicated by the arrow C.

Figure 5:
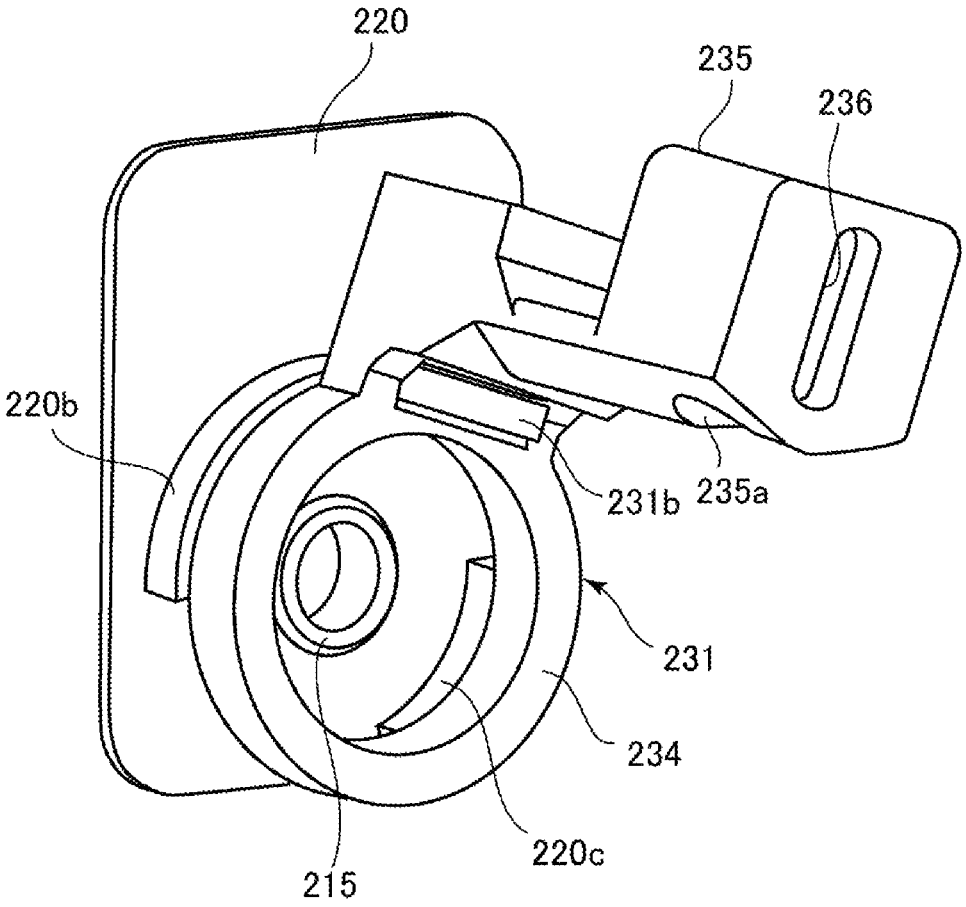
FIG. 5 is an external perspective view of a punch holder.

On the bearing plate 220 (see FIG. 9) opposed to the portion to be engaged 231*b*, an engagement maintaining protruded thread 220*b* of an arc shape provided along a rotation trajectory of the portion to be engaged 231*b* which is formed when the punch holder 231 rotates and the ring portion 234 rotates is protruded toward the portion to be engaged 231*b*. As illustrated in FIG. 5, in order to prevent inclination of the punch holder 231, an inclination preventing protruded thread 220*c* of an arc shape similar to the engagement maintaining protruded thread 220*b* is provided on the bearing plate 220 in a protruding manner toward the punch holder 231 at a position of 180 degrees from the engagement maintaining protruded thread 220*b*.

Functions among the coil spring 232, the protrusion 210*b*, the portion to be engaged 231*b*, and the engagement maintaining protruded thread 220*b* will be described below with reference to FIGS. 8A and 8B.

When the die 210 (see FIG. 2) rotates in the direction indicated by the arrow A, the protrusion 210*b* (see FIGS. 2, 8A, and 8B) also rotates in the direction indicated by the arrow A. The protrusion 210*b* presses the inclined surface 231*ba* of the portion to be engaged 231*b* in the direction indicated by the arrow A while rotating in the direction indicated by the arrow A. The portion to be engaged 231*b* is then supposed to be deflected in the direction indicated by the arrow C but cannot be substantially deflected because the portion to be engaged 231*b* is stopped by the engagement maintaining protruded thread 220*b*. Therefore, the protrusion 210*b* presses the portion to be engaged 231*b* in the direction indicated by the arrow A, and thus rotates the punch holder 231 through the ring portion 234 in the same direction as the die 210 rotates (the direction indicated by the arrow A). As a result, the punch holder 231 rotates following the die 210. At this time, the portion to be engaged 231*b* slides on the engagement maintaining protruded thread 220*b* in a state of being stopped by the engagement maintaining protruded thread 220*b*.

Further, the direction of rotation of the punch holder 231 following the die 210 is a direction of winding the coil spring 232. Therefore, the punch holder 231 rotates in the direction indicated by the arrow A while accumulating the elastic force in the coil spring 232.

When the punch holder 231 rotates by a predetermined amount by being pressed by the protrusion 210*b* (see FIG. 8B), the portion to be engaged 231*b* is separated from the engagement maintaining protruded thread 220*b*. The portion to be engaged 231*b* then moves away in the direction indicated by the arrow C, and thus releases the engagement with the protrusion 210*b*. The punch holder 231 rotates to return in the direction indicated by the arrow B by the elastic force accumulated in the coil spring 232, and then the punch holder 231 is stopped. On the other hand, the die 210 keeps on rotating in the direction indicated by the arrow A. A stopping operation of the punch holder 231 when the punch holder 231 rotates to return will be described later.

In this manner, the coil spring 232, the protrusion 210*b*, the portion to be engaged 231*b*, and the engagement maintaining protruded thread 220*b* are configured to cause the punch holder 231 to rotate following the die 210 during a period in which the die 210 rotates within a predetermined rotation range by the rotation shaft 211. When the die 210 rotates beyond the predetermined rotation range, the punch holder 231 is rotated to return to the initial position. Therefore, a mechanism formed by the coil spring 232, the protrusion 210*b*, the portion to be engaged 231*b*, and the engagement maintaining protruded thread 220*b* is referred to as a reciprocation rotating portion 203.

In this manner, the reciprocation rotating portion 203 rotates the punch holder 231 by engagement of the protrusion 210b and the portion to be engaged 231b, and hence the reciprocation rotating portion 203 can rotate the punch holder 231 reliably to make the punch opposite from the die, thus performing a hole punching operation of the sheet punching device reliably. In addition, the reciprocation rotating portion 203 is configured to rotate the punch holder 231 to return by the coil spring 232, and hence the punch holder 231 can be returned to the initial position in a rapid manner, thus enabling preparation for the next hole punching operation and increasing the punching efficiency.

Further, the protrusion 210*b* and the portion to be engaged 231*b* constitute an engaging and disengaging portion 204 which engages the punch holder 231 with the die 210 during the period in which the die 210 rotates within the predetermined rotation range by the rotation shaft 211 and releases the engagement when the die 210 rotates beyond the predetermined rotation range.

The coil spring 232 as the elastic member is configured to accumulate the elastic force during the period in which the die 210 rotates within the predetermined rotation range by the rotation shaft 211 and to rotate the punch holder 231 to return to the initial position by the accumulated elastic force when the engagement of the engaging and disengaging portion 204 is released.

A range in which the die 210 rotates from when the engaging and disengaging portion 204 is engaged until when the engaging and disengaging portion 204 is released is referred to as the predetermined rotation range.

A guide pin 233 penetrates through the punch 230 at a right angle so as to be provided integrally with the punch 230 (see FIG. 3). The guide pin 233 penetrates through pin guide holes 236 (see FIGS. 3 and 5) formed on the punch guide portion 235, and both ends thereof protrude outside the punch guide portion 235. The pin guide holes 236 are elongated holes formed along the punch guide hole 235*a* toward the rotation axis 231CL of the punch holder 231. A length of the pin guide holes 236 of the elongated hole shape is set to be larger than a moving distance of the punch 230 from the start of its descent to its deepest entry into the die hole 210*c*.

Figure 4:
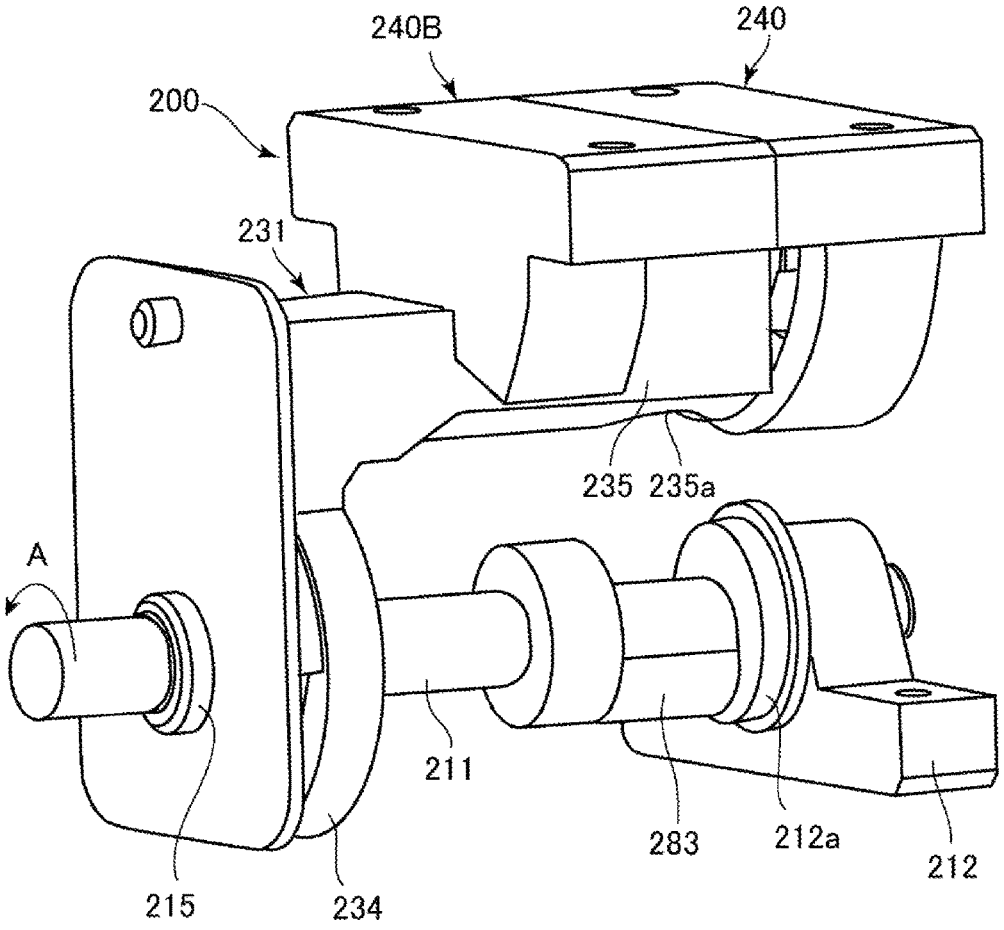
FIG. 4 is an external perspective view of the sheet punching device from which a die is removed.

As illustrated in FIGS. 2 to 4, a pair of fixed punch cams 240A and 240B provided on the frame 201 are provided opposite to the respective sides of the punch guide portion 235 of the punch holder 231 (both sides in the direction along the rotation axis 231CL). On portions of the punch cams 240A and 240B opposed to the punch guide portion 235, groove cams 241A and 241B (see FIG. 10, the groove cam 241B is not shown) as cam portions with which both the ends of the guide pin 233 protruding from the pin guide hole 236 are respectively engaged are formed in a plane-symmetric manner. The groove cam 241B is disposed in a plane-symmetric manner with respect to the groove cam 241A, and hence illustration and description thereof are omitted. Further, in FIG. 10, the guide pin 233 of the punch 230, the pin guide holes 236 formed on the punch guide portion 235 of the punch holder 231, and the groove cams 241A and 241B as the cam portions constitute a punch moving portion 205.

The punch guide portion 235 of the punch holder 231 is configured to reciprocate between the pair of fixed punch cams 240A and 240B when the punch holder 231 holding the punch 230 rotates about the rotation shaft 211 and the die 210 in a reciprocating manner. The groove cam 241A is formed into a shape for allowing the punch 230 to move in and out of the die hole 210*c* by using the reciprocating movement of the punch guide portion 235.

Figure 10:
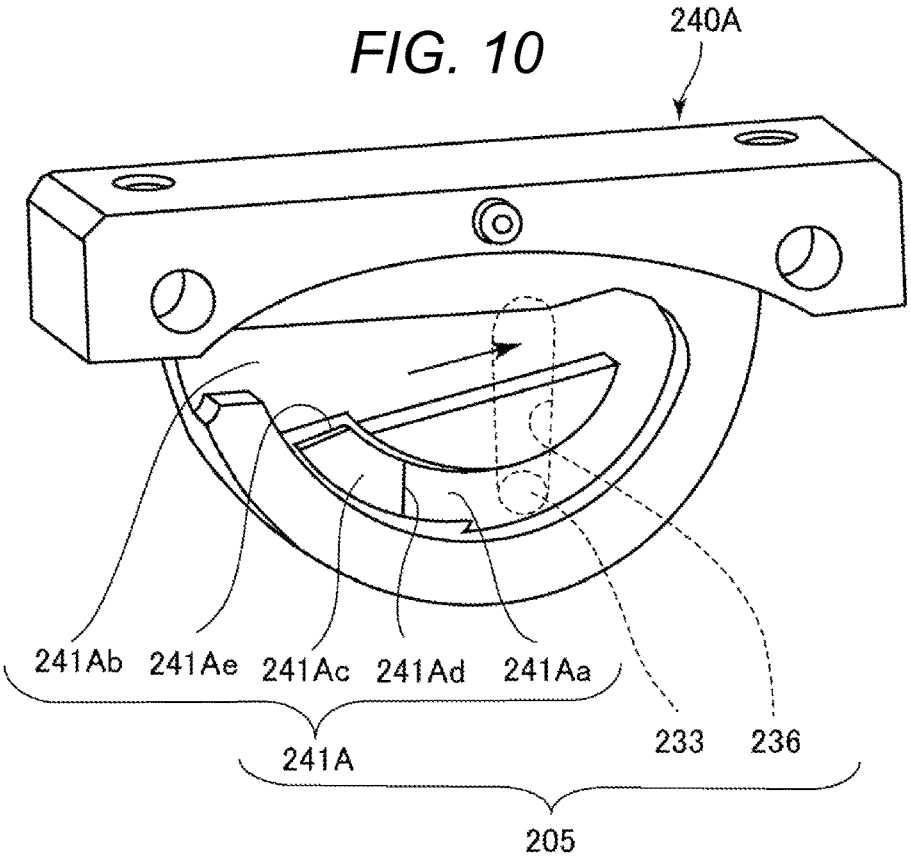
FIG. 10 is a perspective view of the punch cam.
Figure 11:
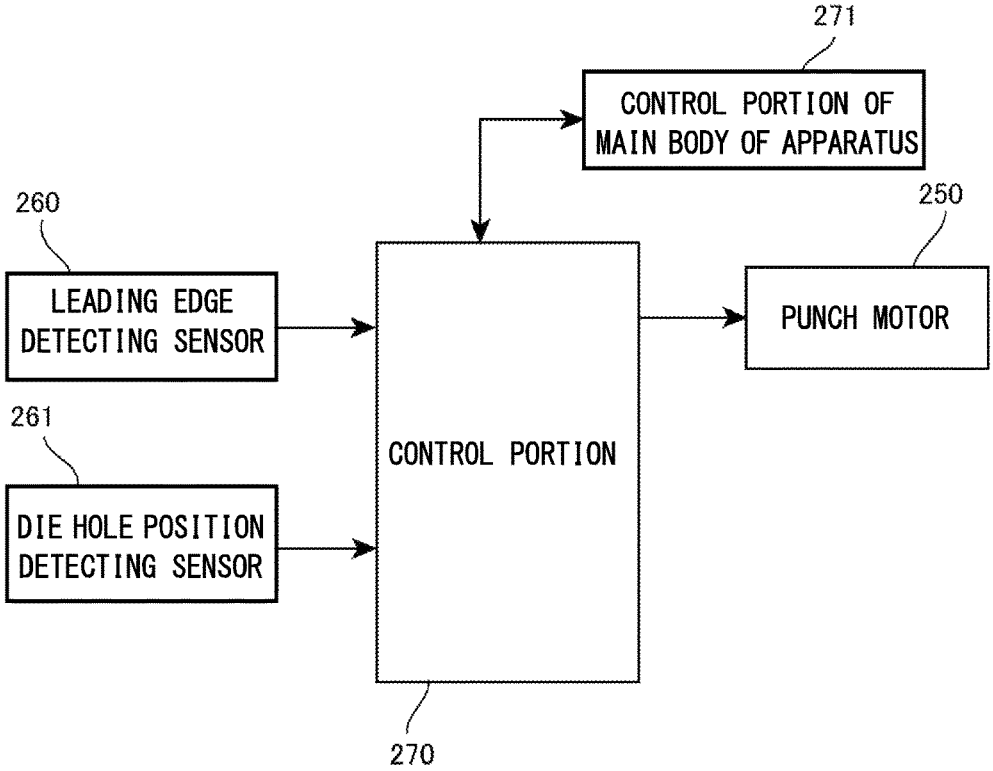
FIG. 11 is a control block diagram of the sheet punching device.

As illustrated in FIG. 10, the groove cam 241A is formed into an endless shape by connecting a leaving path groove 241Aa as a first groove and a return path groove 241Ab as a second groove. The leaving path groove 241Aa is formed into a crescentic shape (arc shape) and is curved protrudingly toward the die 210 (toward the rotation axis 231CL of the punch holder (see FIG. 3)). The leaving path groove 241Aa is configured to move the punch 230 in a direction of moving in and out of the die hole 210*c* when the punch holder 231 holding the punch 230 rotates in synchronization with the die 210 by the engagement of the protrusion 210*b* (see FIGS. 8A and 8B) and the portion to be engaged 231*b*.

The return path groove 241Ab formed into a straight line shape is configured to hold the punch 230 at a position separated from the die hole 210*c*. A period during which the return path groove 241Ab holds the punch 230 is a period from when the engagement of the protrusion 210*b* and the portion to be engaged 231*b* is released and the punch holder 231 starts to rotate to return to the initial position by the coil spring 232 until when the protrusion and the portion to be engaged are engaged with each other again and the punch holder starts to rotate following the die.

As illustrated in FIG. 10, a one-way claw 241Ac is formed on a terminal portion of the leaving path groove 241Aa. The one-way claw 241Ac is provided to stop and prevent the guide pin 233 from turning back to the leaving path groove 241Aa when the guide pin 233 is guided from the leaving path groove 241Aa to the return path groove 241Ab. The one-way claw 241Ac is inclined in a direction in which a stopper edge 241Ae provided on the terminal side of the leaving path groove 241Aa is lifted from a bottom of the leaving path groove 241Aa, with a beginning of the leaving path groove 241Aa as a base portion 241Ad. The one-way claw 241Ac is formed into a reed piece shape and has elasticity.

The one-way claw 241Ac is pressed by the guide pin 233 when the guide pin 233 passes through the leaving path groove 241Aa, and is deflected in a direction of sinking into the leaving path groove 241Aa, thus allowing the guide pin 233 to pass. When the guide pin 233 has passed, the one-way claw 241Ac returns to the original state by its elasticity, and the stopper edge 241Ae is lifted from the bottom of the leaving path groove 241Aa. Therefore, when the guide pin 233 is caused to turn back to the leaving path groove 241Aa, the one-way claw 241Ac receives the guide pin 233 with the stopper edge 241Ae, thus preventing the guide pin 233 from turning back to the leaving path groove 241Aa. As a result, the guide pin 233 is guided to the return path groove 241Ab reliably.

In this manner, the punch moving portion 205 is configured to guide and move the guide pin 233 of the punch 230 to the groove cams 241A and 241B to cause the punch 230 to move in and out of the die hole 210*c*, and hence it is possible to perform the hole punching operation of the punch 230 reliably.

A control portion 270 (see FIGS. 1 and 11) is configured to control the sheet punching device 200 while transmitting/receiving a signal to/from a control portion 271 of the apparatus main body 100A of the image forming apparatus 100, and is connected to a leading edge detecting sensor 260, a die hole position detecting sensor 261, and the punch motor 250.

The control portion 270 may be provided in the apparatus main body 100A of the image forming apparatus 100. Alternatively, any one of the control portion 270 and the control portion 271 may be incorporated in the other and provided in any one of the apparatus main body 100A and the sheet punching device 200.

The leading edge detecting sensor 260 is provided at an entrance of the sheet punching device 200 (see FIG. 1) and is configured to detect a leading edge of the sheet. The die hole position detecting sensor 261 is configured to detect a flag protrusion 210*e* (see FIG. 2) provided on the outer circumference of the die 210 in a protruding manner, to thereby detect a rotation position of the die hole 210*c*. The flag protrusion 210*e* may be provided on the rotation shaft 211 integrated with the die 210, and the die hole position detecting sensor 261 may be provided at a position where the flag protrusion 210*e* can be detected.

In the above-mentioned configuration, the punch holder 231 as the punch holding member (see FIGS. 2 and 5), the reciprocation rotating portion 203 (see FIGS. 3, 8A and 8B), and the punch moving portion 205 (see FIG. 10) constitute a punch operating unit.

An overall operation of the sheet punching device 200 will be described below.

Figure 12A:
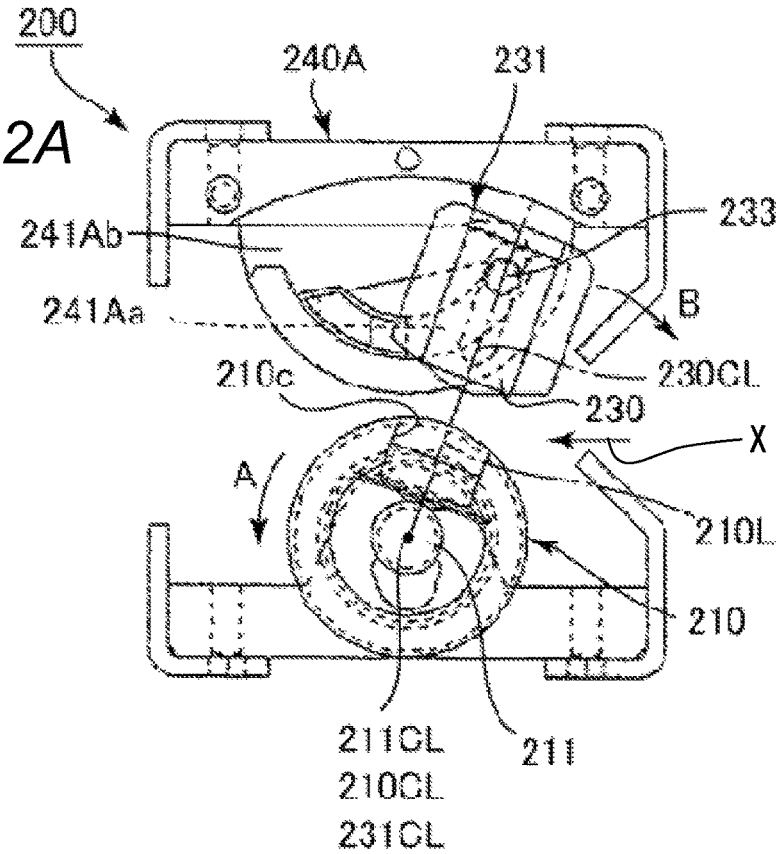
FIGS. 12A, 12B, and 12C are diagrams for illustrating an operation of the sheet punching device.
Figure 12B:
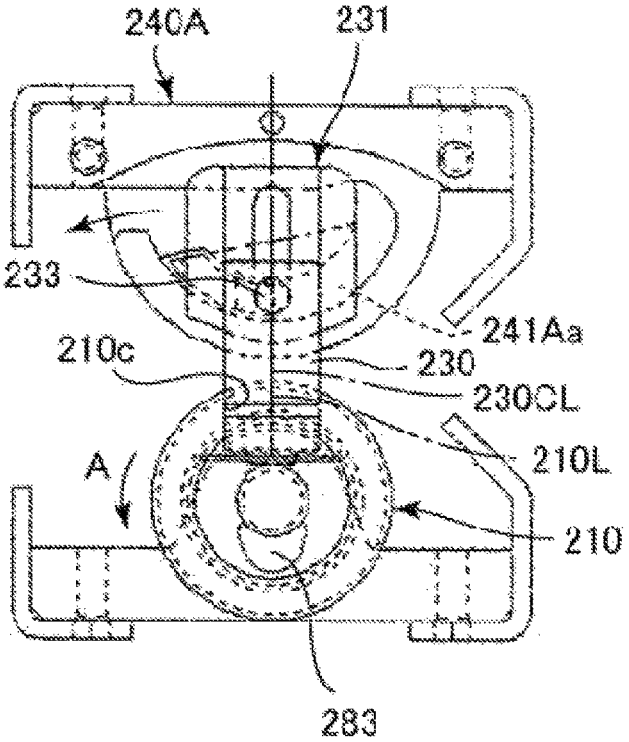

The sheet is conveyed in a sheet conveying direction indicated by the arrow X in FIG. 12A.

When the sheet punching device 200 is stopped, the punch holder 231 is rotationally biased in the direction indicated by the arrow B (see FIG. 2) by the coil spring 232 (see FIG. 12A). The rotation of the punch holder 231 which is rotationally biased is restricted by both ends of the guide pin 233 protrudingly provided in the punch 230 when the respective ends of the guide pin 233 abut against a boundary between the beginning of the leaving path groove 241Aa and the terminal of the return path groove 241Ab of the groove cam 241A and a boundary between the beginning of a leaving path groove and the terminal of a return path groove of the groove cam 241B, which are formed on each of the fixed punch cams 240A and 240B. The groove cam of the punch cam 240B is omitted in the drawings. This position where the rotation is restricted is the initial position of the punch holder 231.

Further, as illustrated in FIG. 12A, when the punch holder 231 is at the initial position, the punch 230 stands by at a position where the punch 230 is pulled out of the die hole 210*c*. This position is the initial position of the punch 230.

The die 210 is assumed to be stopped in a state in which the protrusion 210*b* of the die 210 abuts against the portion to be engaged 231*b* of the punch holder 231 located at the initial position by the punch motor 250 after the previous use of the sheet punching device 200.

When a user activates the power on state, the sheet punching device 200 thus stopped in the standby state is started by the control portion 270. The control portion 270 (see FIG. 11) determines a start timing of the punch motor 250 based on leading edge detection information of the sheet fed from the apparatus main body 100A, the leading edge detection information being obtained by the leading edge detecting sensor 260 (see FIG. 11), and position detection information of the die hole obtained by the die hole position detecting sensor 261. The start timing of the punch motor 250 differs depending on a position of a hole from the leading edge of the sheet.

Figure 13A:
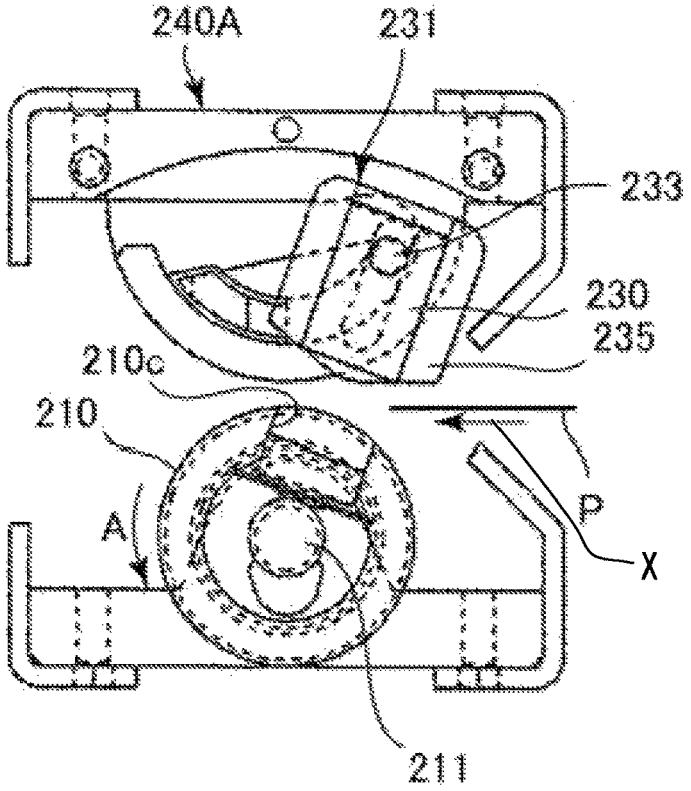
FIGS. 13A, 13B, and 13C are diagrams for illustrating an operation of the sheet punching device at the time of separating the sheet from the punch by a punch guide portion when the sheet is raised together with the punch without being separated from the punch after a hole is punched in the sheet by the punch.
Figure 13B:
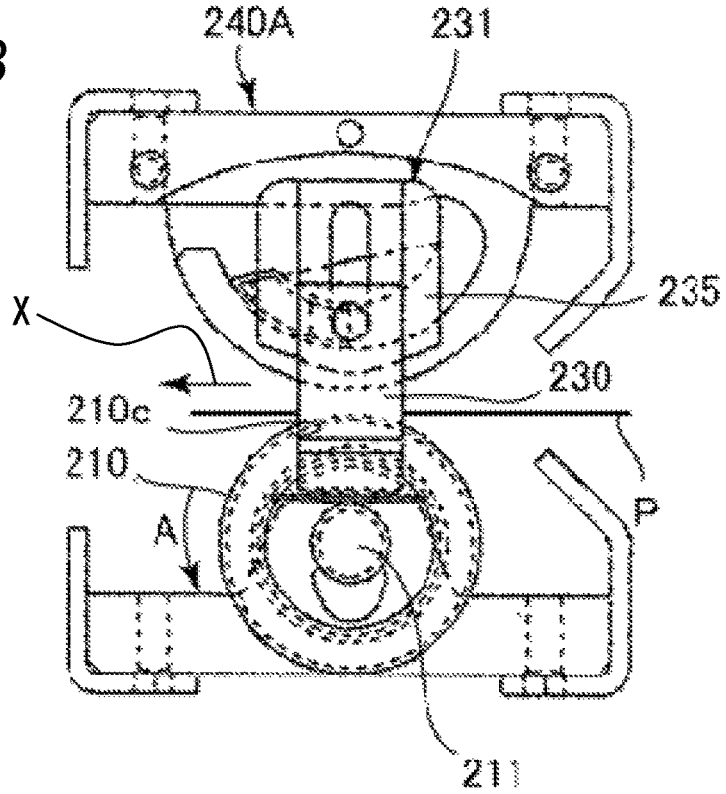

The sheet P is conveyed in the sheet conveying direction indicated by the arrow X in FIGS. 13A and 13B.

When the punch motor 250 is started, the rotation shaft 211 (see FIGS. 2 and 13A to 13C) rotates in the direction indicated by the arrow A. Along with the rotation of the rotation shaft 211, the die 210 formed integrally with the rotation shaft 211 also starts to rotate in the direction indicated by the arrow A. The die 210 starts to rotate in the direction indicated by the arrow A while the protrusion 210*b* presses the punch holder 231 through the portion to be engaged 231*b* (see FIGS. 8A and 8B). At this time, as illustrated in FIG. 8A, the protrusion 210*b* presses the inclined surface 231*ba* of the portion to be engaged 231*b* in a state that the engagement between the protrusion 210*b* and the portion to be engaged 231*b* of the engaging and disengaging portion 204 is maintained, thus rotating the punch holder 231 in the direction indicated by the arrow A.

With these operations, the punch holder 231, the die 210, the die hole 210*c*, and the rotation shaft 211 rotate about the rotation axes 231CL, 210CL, and 211CL (see FIG. 12A), respectively. These rotation axes are at the same position, and hence the punch holder 231, the die 210, the die hole 210*c*, and the rotation shaft 211 rotate about the common rotation axis in a synchronized manner. As a result, the punch holder 231 rotates in the direction indicated by the arrow A while maintaining a state in which the punch is held to rotate about the rotation axis of the die, the punch is opposed to the die hole along with the rotation of the die, and an axis 230CL (see FIG. 12B) of the punch is matched with an axis 210L of the die hole. The axis 230CL of the punch and the axis 210L of the die hole are directed to the rotation axes 231CL, 210CL, and 211CL.

Figure 12C:
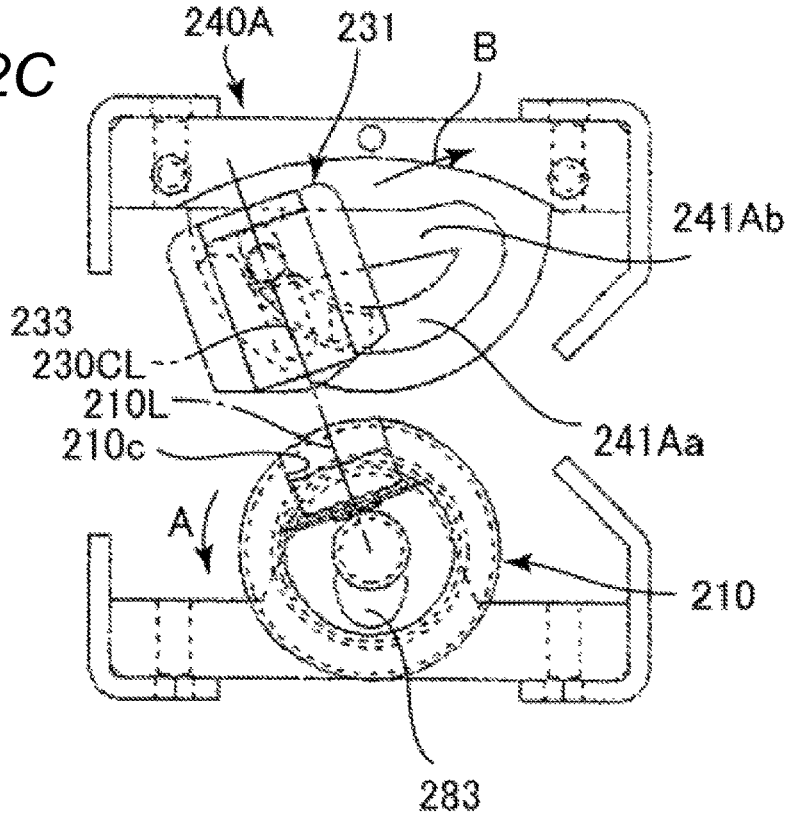

When the punch holder 231 rotates in the direction indicated by the arrow A, the guide pin 233 of the punch is guided and moved along the leaving path groove 241Aa (see FIGS. 12A and 12B), and arrives at the return path groove 241Ab (see FIG. 12C). During this time, the punch 230 punches a hole in the sheet by moving in and out of the die hole 210*c*. That is, the punch 230 moves in and out of the die hole 210*c* to punch the hole in the sheet during a period in which the punch holder 231 performs a leaving rotation.

At the substantially same time as the guide pin 233 of the punch 230 arrives at the return path groove 241Ab, as illustrated in FIG. 8B, the portion to be engaged 231*b* moves away so that the engaged state of the engaging and disengaging portion 204 is released. The punch holder 231 has rotated so far in the direction indicated by the arrow A while accumulating the elastic force in the coil spring 232, and hence the punch holder 231 then rotates to return from the position illustrated in FIG. 12C to the initial position corresponding to the position illustrated in FIG. 12A by the elastic force accumulated in the coil spring 232.

When the punch holder 231 rotates to return in the direction indicated by the arrow B, the guide pin 233 is guided along the return path groove 241Ab and returns to the initial position illustrated in FIG. 12A. Therefore, the punch 230 is pulled out of the die hole 210*c* and held at the position away from the die hole 210*c*.

In this manner, the sheet punching device 200 can punch a hole in the sheet during a period in which the punch holder 231 performs one reciprocating rotation.

Figure 13C:
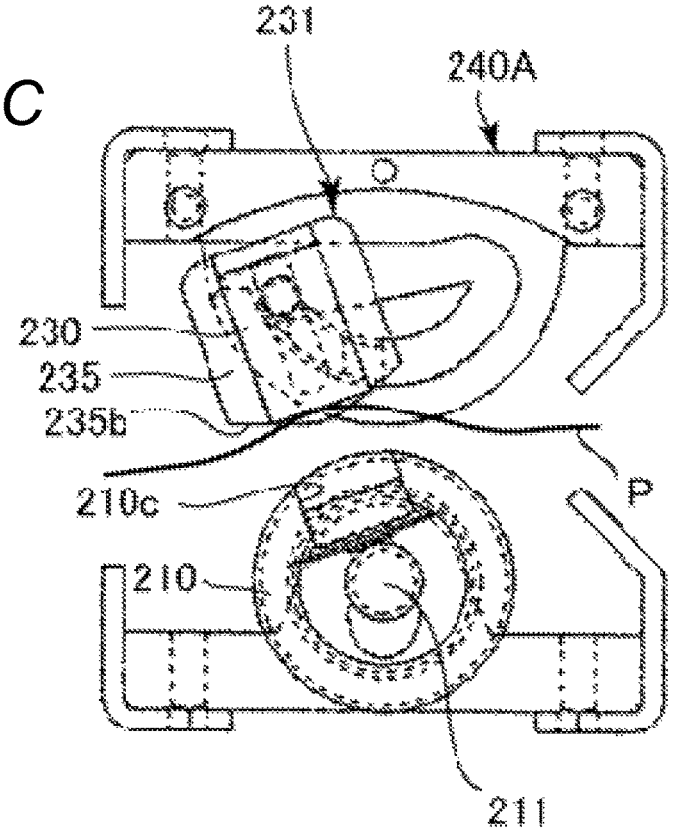

When the punch 230 returns after punching the hole in the sheet as illustrated in FIGS. 13A and 13B, as illustrated in FIG. 13C, the sheet P may be lifted while being engaged with the punch 230. However, a lower edge portion 235*b* of the punch guide portion 235 which guides the punch 230 receives the sheet so as to separate the sheet from the punch 230 along with the return of the punch 230 into the punch guide portion 235. Therefore, the punch guide portion 235 of the punch holder 231 also serves as a sheet stripper.

As described above, the punch and the die have the same rotation axis, and hence the sheet punching device can rotate the punch and the die hole in a synchronized manner with their phases matched with each other in a state in which the punch is opposed to the die hole and the axis of the punch and the axis of the die hole are matched with each other during the period in which the die is rotating within the predetermined rotation range. As a result, the sheet punching device can punch a hole in the sheet without stopping the conveyance of the sheet and without causing substantially any galling between the punch and the die hole.

Therefore, the sheet punching device 200 has an effect that a hole can be punched in the sheet with accuracy and efficiency, and the punch and the die can be used for a long period of time.

By the way, as illustrated in FIG. 3 and FIGS. 17A to 17C, the die hole 210*c* is formed in the cylindrical portion 210*a* of the columnar die 210, and an entrance 210*ca* of the die hole 210*c* is formed on the circumferential of the die 210. Therefore, the die entrance 210*ca* is formed so that a length N (FIG. 17B) along the circumferential direction of the die 210 is longer than a length M (FIG. 17A) in a direction along the rotation axis 210CL of the die 210 (N>M). When the columnar punch 230 having a perfect circle shape in cross-section proceeds into the entrance 210*ca* of such a shape to punch a hole in the sheet, the punched hole (FIG. 17C) has a shape in which the length N along the circumferential direction of the die 210 is longer than the length M in the direction along the rotation axis 210CL (N>M). That is, the punched hole is an elongate hole (elliptical hole) having a longer diameter N and a shorter diameter M, and a perfect circle shape is not formed.

Figure 20A:
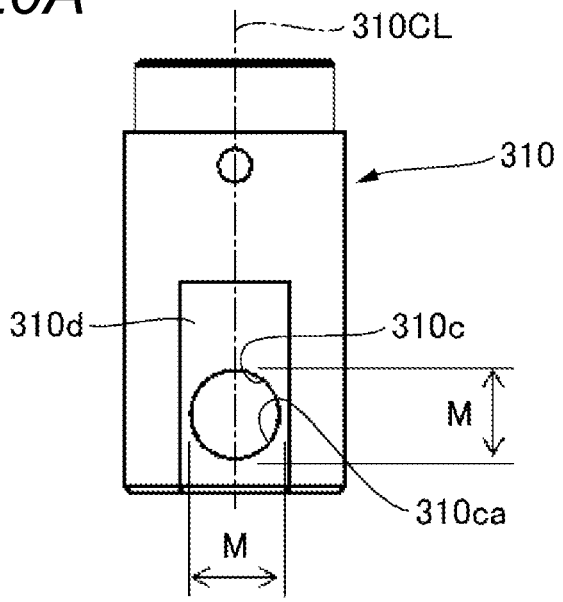
FIGS. 20A, 20B, and 20C are diagrams of the die used in FIG. 18.
Figure 20B:
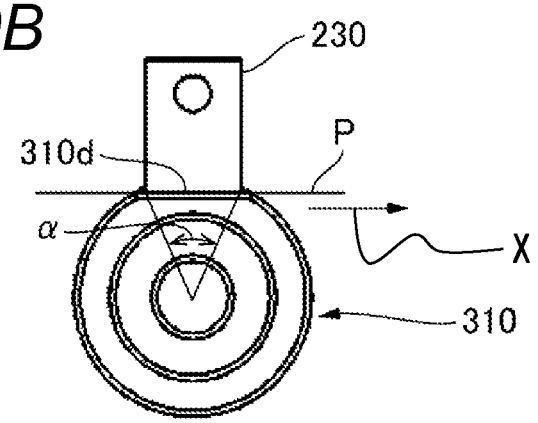
Figure 20C:
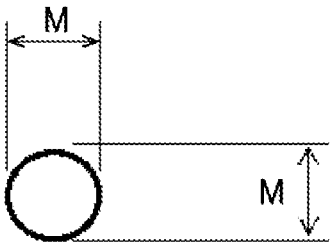

Therefore, as in a die 310 as illustrated in FIG. 18, FIGS. 19A and 19B, and FIGS. 20A to 20C, when a flat part 310*d* is formed on the outer periphery, and a die hole 310*c* is formed in a flat part 310*d*, it is possible to punch a perfect circle in the sheet. In this case, in an entrance 310*ca* of the die 310, a length M (FIG. 20A) in a direction along a rotation axis 310CL of the die 310 and a length M (FIG. 20A) of the rotation direction of the die 310 along a flat part 310*d* of the die 310 are the same (N=M). That is, the entrance 310*ca* is formed into a perfect circle. Therefore, the shape of a hole, which is punched in the sheet by the columnar punch 230 having a perfect circle in cross-section proceeding into the entrance 310*ca* having the perfect circle of the die hole 310*c*, has a perfect circle (FIG. 20C).

As described above, when the die hole 310*c* is formed in a flat part (flat part 310*d*) formed on an outer periphery of the die 310, the sheet punching device punches a hole having a perfect circle in the sheet.

Figure 21A:
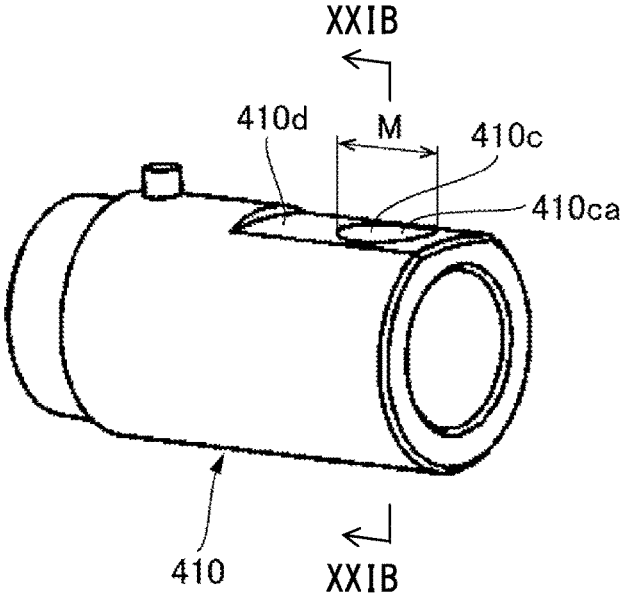
FIGS. 21A and 21B are diagrams of a further another die.
Figure 21B:
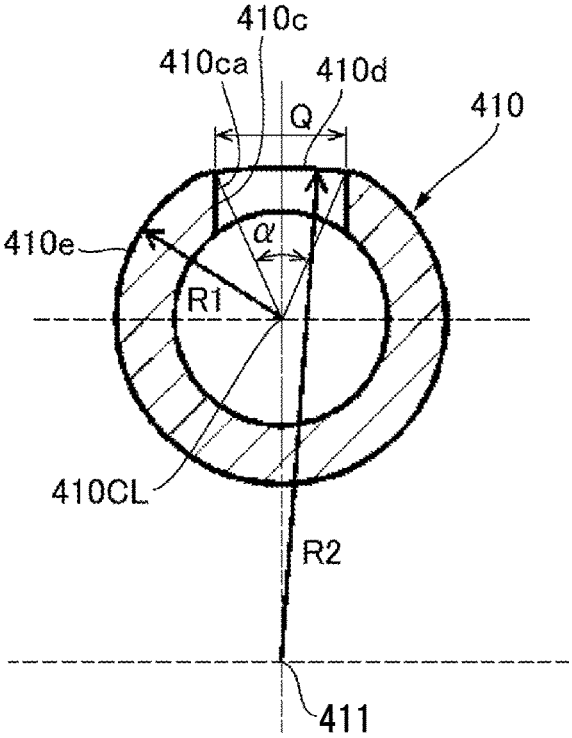

It should be noted that, the flat part 310*d* of FIG. 18 to FIGS. 20A to 20C may be formed into an arc part 410*d* having a slightly arced shape as illustrated in FIGS. 21A and 21B, and a die hole 410*c* may be formed in the arc part 410*d*. The arc part 410*d* is formed on an arc surface having a curvature radius R2 which is larger than a radius R1 (namely, radius of die 410) of an outer circumferential surface 410*e* of a die 410 as a center of a rotation axis 410CL of the die 410. As a result, in the entrance 410*ca* of the die hole 410*c*, a length Q (FIG. 21B) in a direction along the periphery of the die 410 is formed so as to be slight longer than the length M (FIG. 21A) in a direction along the rotation axis 410CL of the die 410. However, the length Q is shorter than the length N of FIG. 17B (N>Q>M). The hole of the sheet punched by the die hole 410*c* is closer to a perfect circle than the ellipse illustrated FIG. 17C.

The curvature radius R2 of the arc part 410*d* has a point 411 as a center. It should be noted that when the curvature radius R2 of the arc part 410*d* is set as infinity, the arc part 410*d* becomes the flat part 310*d*.

As described above, even if center angles $\alpha$ of the dies 210, 310, and 410 corresponding to a diameter of the punch 230, are the same, as the length of the entrances 210*ca*, 310*ca*, and 410*ca* in the rotation direction of the respective dies shorter, it is possible to punch the hole in the sheet, which is closer to a perfect circle, or a perfect circle.

In addition, the image forming apparatus 100 includes the sheet punching device that can punch a hole in the sheet in an efficient manner, and hence it is possible to enhance efficiency in an image forming operation.

By the way, when punching a hole in the sheet by the punch 230 and the die 210 in the sheet punching device 200, a chad generated by the hole punching may be jammed in the die hole without being discharged even when the die hole 210*c* faces downward, resulting in trouble in the subsequent hole punching operation.

Figure 6:
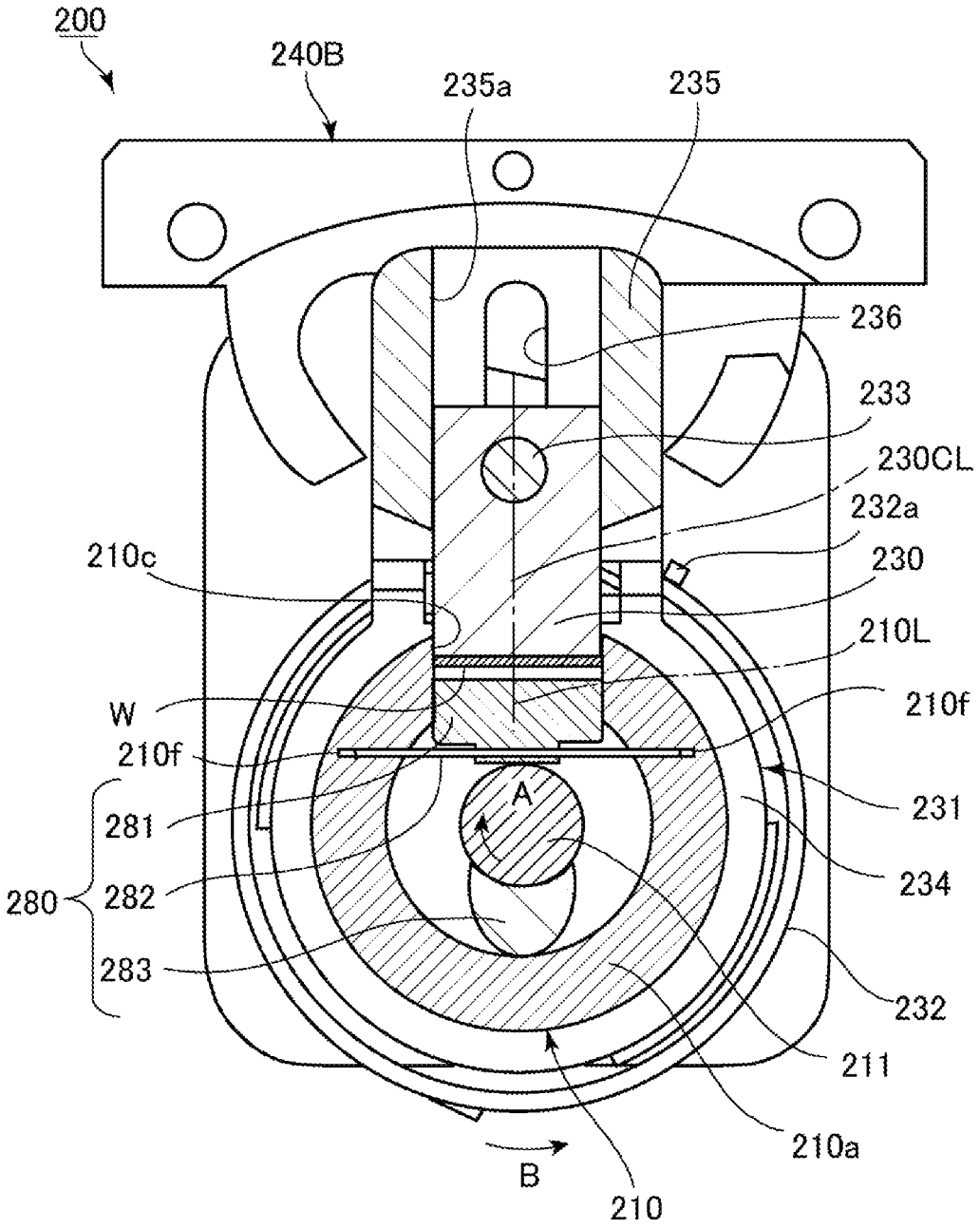
FIG. 6 is a cross-sectional view of the sheet punching device taken along an arrow VI-VI in FIG. 3.
Figure 14:
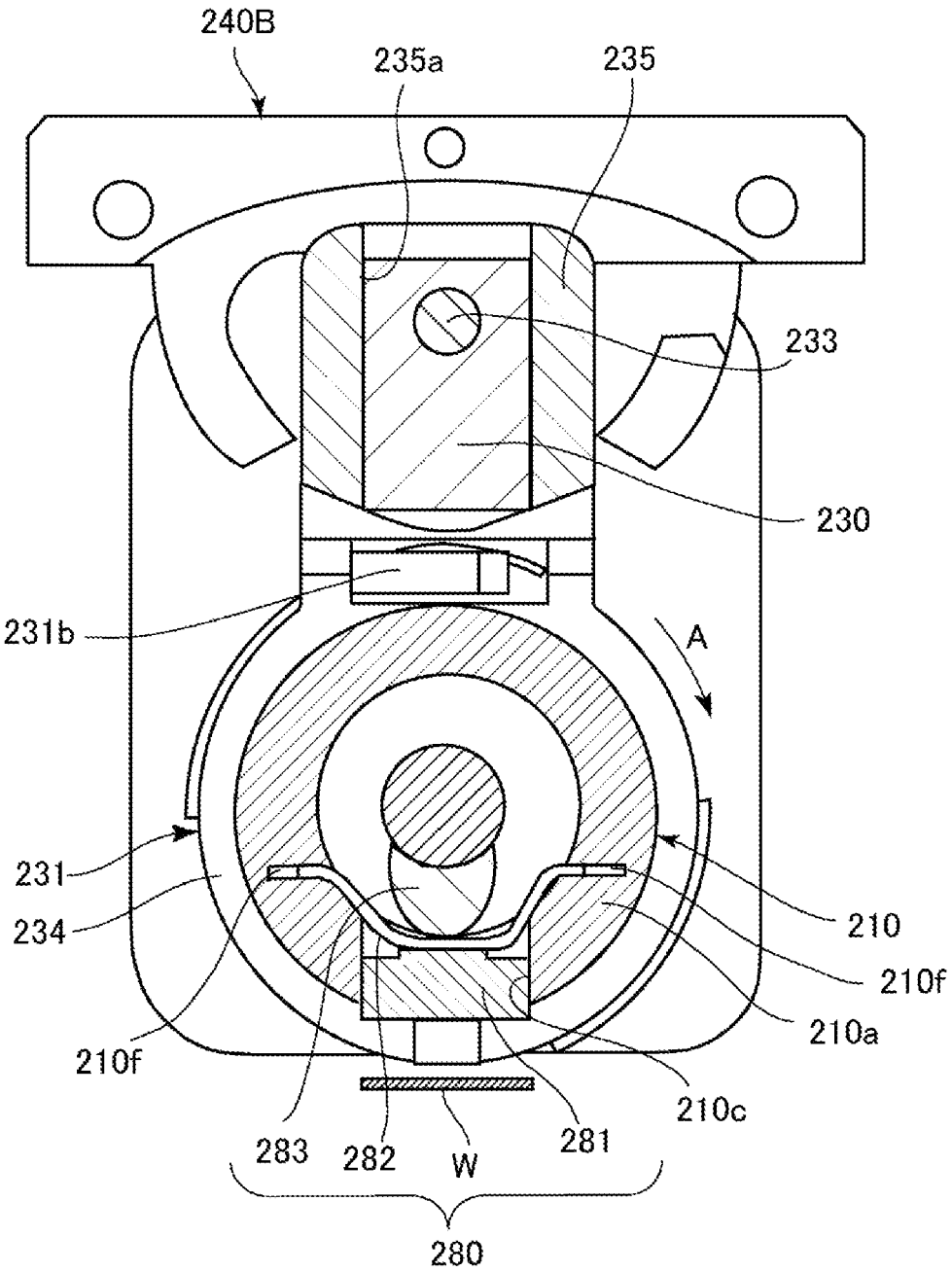
FIG. 14 is a diagram for illustrating an operation of a chad discharging mechanism, and for illustrating a state in which the punch is moved out of the die hole in FIG. 6.

To cope with this problem, as illustrated in FIGS. 6 and 14, the sheet punching device 200 includes a chad discharging mechanism 280 that discharges the chad W jammed in the die hole 210*c*. The chad discharging mechanism 280 includes a chad pusher 281, a piano wire 282, and a pusher cam 283 (see FIG. 4).

The chad pusher 281 as a moving member includes the piano wire 282 as an elastic member. Both ends of the piano wire 282 are respectively inserted into piano wire supporting holes 210*f* formed in the cylindrical portion 210*a* so that the piano wire 282 holds the chad pusher 281 in such a manner that the chad pusher 281 is movable in the die hole 210*c*. The chad pusher 281 is further configured to protrude from the die hole by being pressed by the pusher cam 283.

The pusher cam 283 as a pressing portion is faced downward and provided integrally with a portion of the rotational bearing 212 located in the cylindrical portion 210*a* (see FIGS. 3, 6, and 14) in which the die hole 210*c* of the die 210 is formed.

In the above-mentioned configuration, the punch 230 proceeds into the die hole 210*c* to punch a hole in the sheet, and then presses the chad W (see FIG. 6) into the die hole 210*c*. At this time, the chad pusher 281 is pulled into the die hole 210*c* by the piano wire 282, and hence the chad pusher 281 is not pressed by the tip of the punch 230 through the chad W.

The die 210 keeps on rotating. Therefore, the die hole 210*c* rotates in the downward direction while being separated from the punch 230, and accordingly, the chad pusher 281 in the die hole 210*c* also rotates in the downward direction together with the die hole 210*c*. At this time, the chad pusher 281 enters into a bottom side of the pusher cam 283, is pressed by the pusher cam 283, moves in a direction of protruding outside the die 210 from the die hole 210*c* against the elastic force of the piano wire 282, and pushes the chad in the die hole 210*c* out of the die hole 210*c*. At this time, the piano wire 282 moves in a direction of coming out of the piano wire supporting holes 210*f* while being deflected from a straight line state to a curved state, but is not fallen out of the piano wire supporting holes 210*f*. In this manner, the pusher cam 283 is located on an inner side in a rotation radial direction of the die and causes the chad pusher 281 to protrude from the die hole by a relative rotation to the die.

Even after that, the die 210 keeps on rotating. Therefore, the die hole 210*c* and the chad pusher 281 also keep on rotating, and hence the chad pusher 281 leaves from the bottom side of the pusher cam 283 and a state of the chad pusher 281 being pressed by the pusher cam 283 is released. The piano wire 282 is then returned to the straight line state, and the chad pusher 281 is returned into the die hole 210*c*. With this configuration, the die hole 210*c* is opposed to the punch 230 in a state in which the chad pusher 281 is pulled into the die hole 210*c*, thus enabling preparation for the next hole punching operation.

Figure 15A:
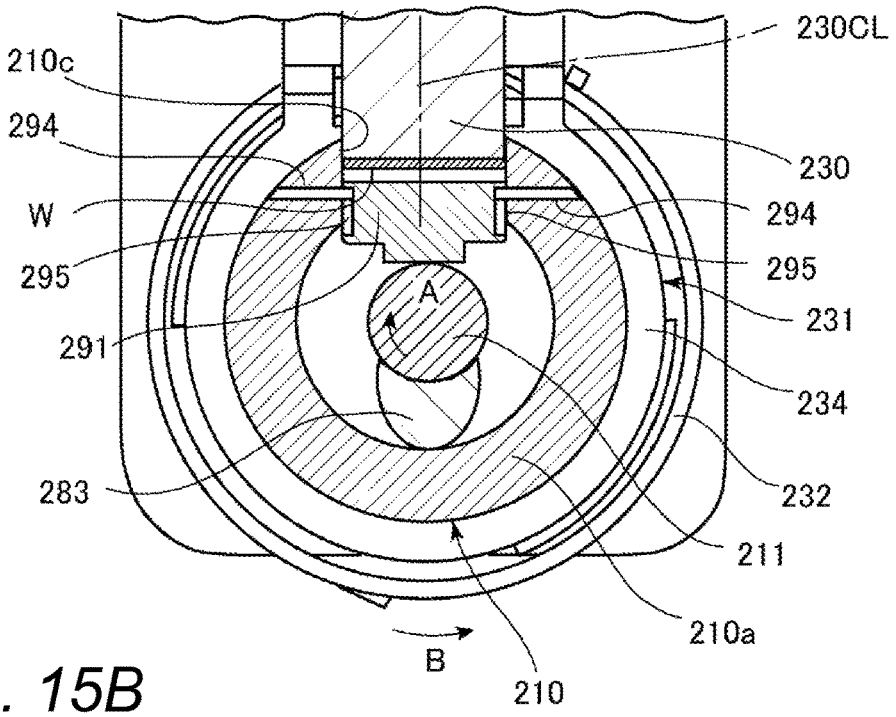
FIGS. 15A and 15B are diagrams for illustrating a chad discharging mechanism according to another embodiment.
Figure 15B:
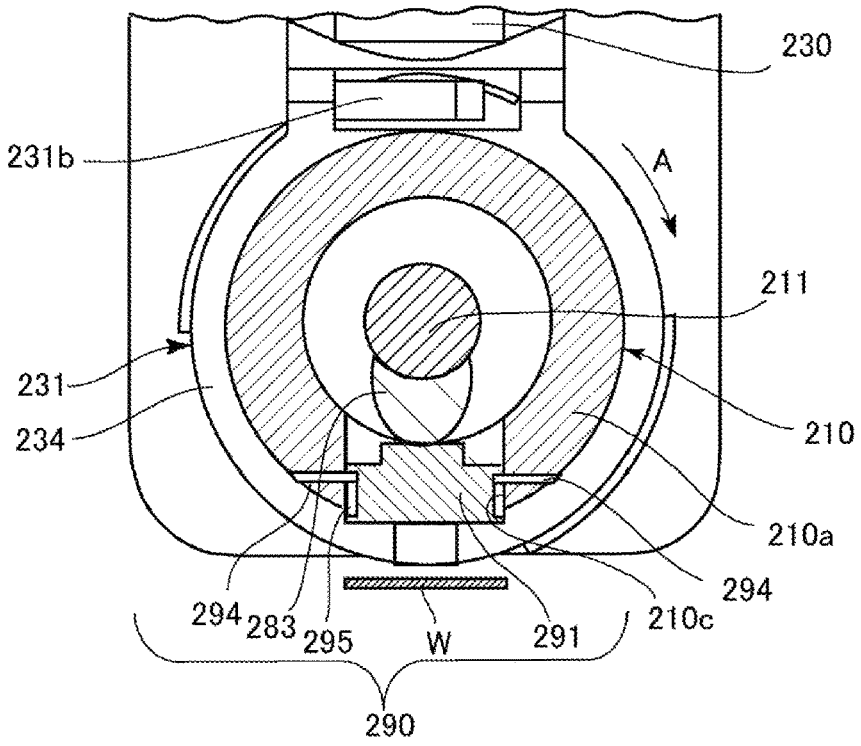

The piano wire 282 of the chad discharging mechanism 280 described above is provided to prevent the chad pusher 281 from falling out due to a centrifugal force caused by the rotation of the die 210 or the die hole 210*c* facing downward, and to return the chad pusher 281 into the die hole 210*c*. However, as in a chad discharging mechanism 290 illustrated in FIG. 15B, engaging pins 294 and engaging grooves 295 may be used instead of the piano wire 282. The engaging pins 294 are provided on the cylindrical portion 210*a* of the die 210 so as to protrude from both sides into the die hole 210*c*. The engaging grooves 295 are elongated groove formed in both sides of a chad pusher 291 along an axis of the chad pusher 291, and are engaged with tip portions of the engaging pins 294.

Therefore, the engaging pins 294 and the engaging grooves 295 can restrict the chad pusher 291 from falling out due to the centrifugal force caused by the rotation of the die 210 or the die hole 210*c* facing downward.

Figure 16A:
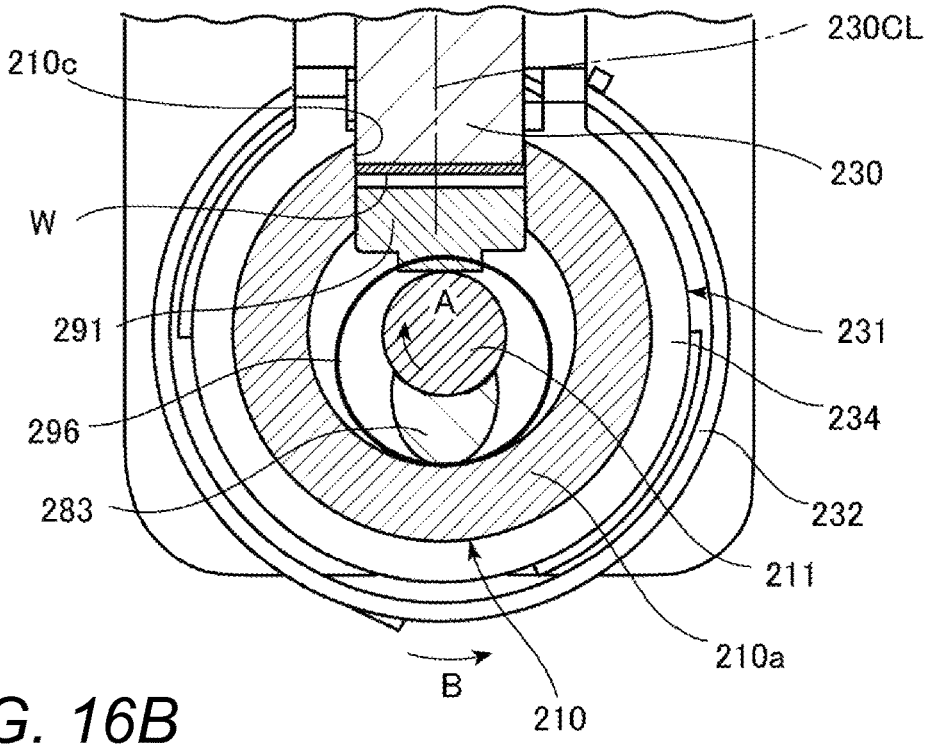
FIGS. 16A and 16B are diagrams for illustrating a chad discharging mechanism according to still another embodiment.
Figure 16B:
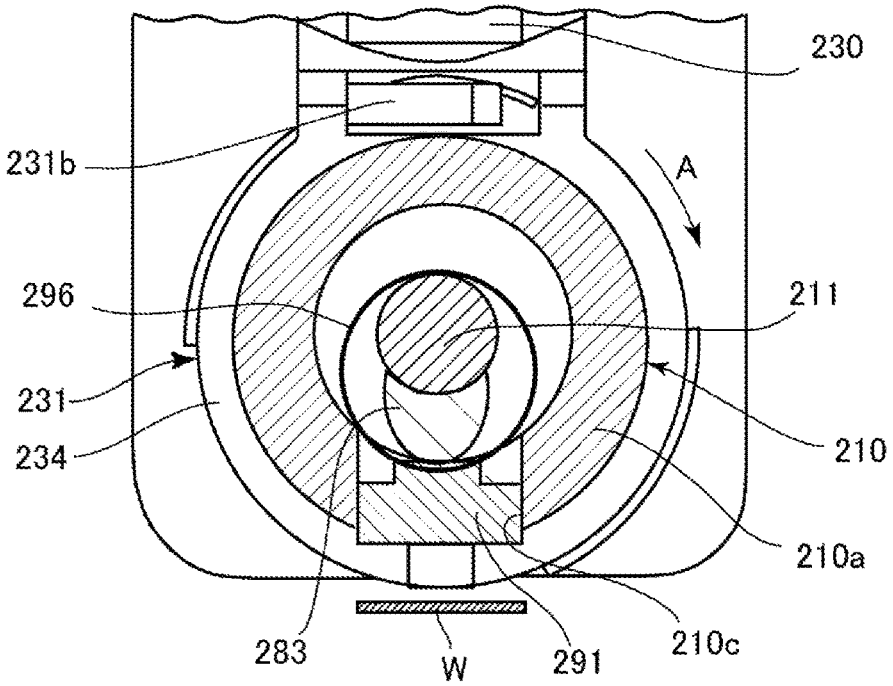
Figure 17A:
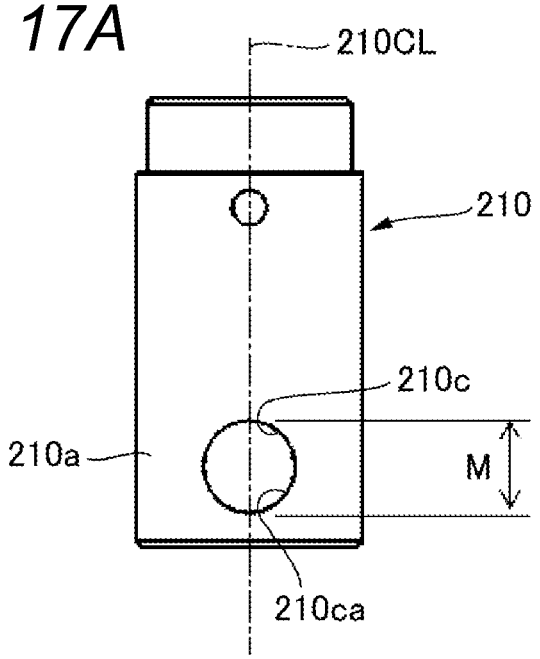
FIGS. 17A, 17B and 17C are diagrams of the die.
Figure 17B:
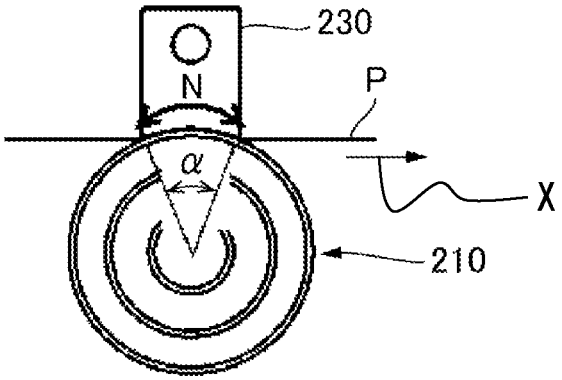
Figure 17C:
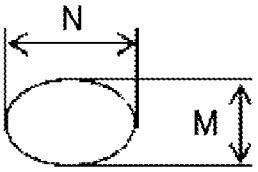
Figure 18:
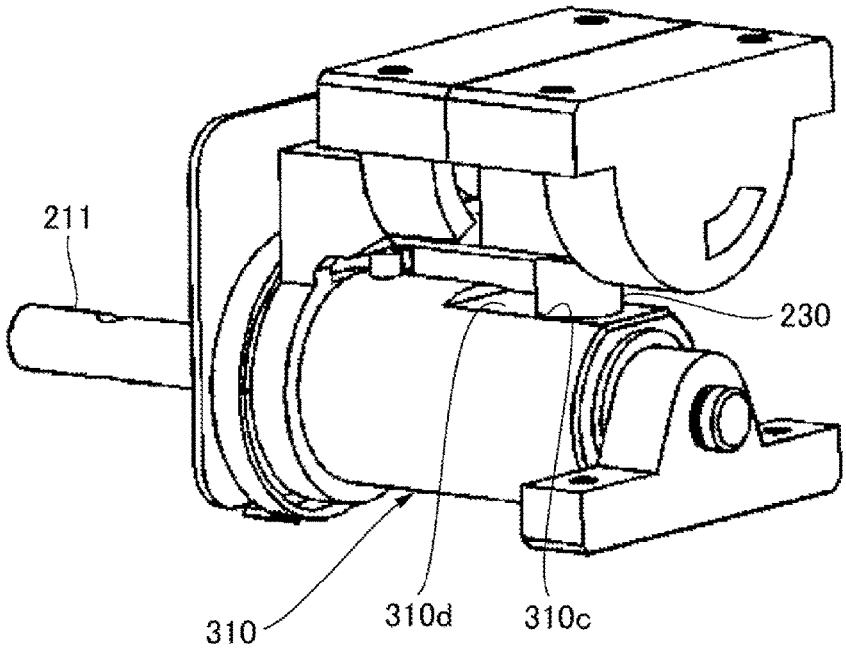
FIG. 18 is an outer appearance perspective view of the sheet punching device provided with a die having another shape.
Figure 19A:
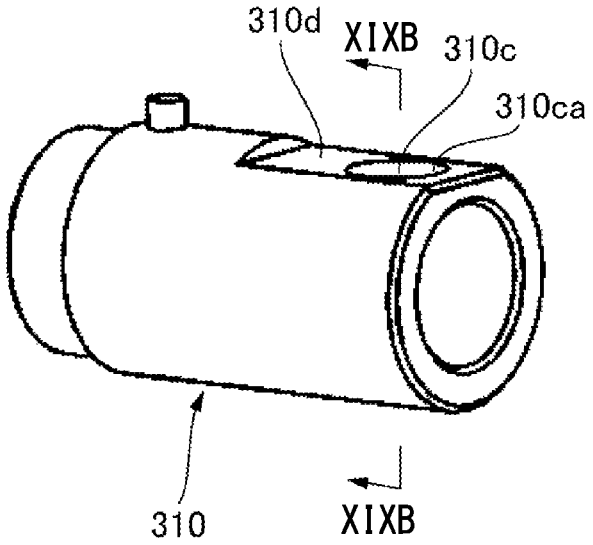
FIGS. 19A and 19B are diagrams of the die used in FIG. 18.
Figure 19B:
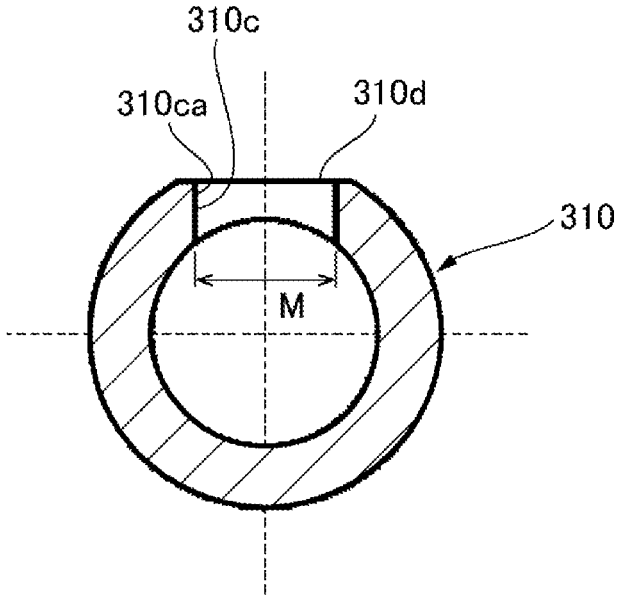

Further, as illustrated in FIGS. 16A and 16B, the chad pusher 291 may be supported by a ring 296 provided in the inner side of the die by using a ring shaped member instead of the piano wire 282. The ring 296 may be any one of an elastic member and a rigid member. In this case, the chad pusher 291 can push out the chad at a position of the pusher cam portion and be retracted to the inner side by the ring 296 after passing through the pusher cam portion.

The sheet punching device 200 according to this embodiment is configured to discharge the chad when the die hole 210*c* faces downward, but may be configured to discharge the chad in a lateral direction when the die hole 210*c* faces the lateral direction by providing the pusher cam 283 at a position at which the pusher cam 283 faces laterally. Therefore, the discharge position of the chad is not limited to the downward direction. However, the downward direction is easier to discharge the chad.

As described above, in the sheet punching device, the chad pusher is forcibly pressed by the pusher cam so as to forcibly push out the chad, and is protruded from the die hole to discharge the chad. Accordingly, it is possible to discharge the chad from the die hole in a forced manner, thus preventing the chad jam.

Therefore, the sheet punching device eliminates a need for a chad removing operation caused by the chad jam, and thus increases the hole punching efficiency. In particular, the sheet punching device 200 produces a significant effect when a thick sheet is used. In addition, by eliminating the chad jam, the sheet punching device can punch a hole in the sheet with accuracy.

In addition, when the chad pusher 281 is held in the die hole 210*c* by the piano wire 282, in many cases, the sheet punching device does not push out the chad unnecessarily to scatter the chad by moving the chad pusher 281 in the direction in which the chad pusher 281 protrudes by the centrifugal force caused by the rotation of the die 210. Therefore, a surrounding area of the sheet punching device can be maintained in a clean condition.

As described above, the image forming apparatus according to the present invention includes the sheet punching device that can punch a hole in the sheet with efficiency, and hence it is possible to enhance efficiency of an image forming operation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2011-245995, filed Nov. 9, 2011, and No. 2012-187785, filed Aug. 28, 2012 which are hereby incorporated by reference herein in their entirety.

What is claimed is:

1. A sheet punching device, comprising:

a die which has a die hole and is configured to be driven to rotate;

a punch configured to punch a hole in a sheet;

a punch holding portion configured to hold the punch, the punch holding portion being configured to rotate in a first direction around a rotation axis of the die in synchronization with the die from a predetermined area, and then to return in a second direction different from the first direction to the predetermined area, the punch holding portion having:

a first portion having a length extending in a direction parallel to the rotation axis, wherein the first portion has a first end and a second end, and the punch is held by the first portion adjacent to the second end, and a second portion extending from the first end of the first portion and surrounding the the rotation axis; and a punch moving portion configured to move the punch in and out of the die hole, the punch moving portion being configured to move the punch into, and then out of, the die hole while the punch holding portion rotates in the first direction around the rotation axis in synchronization with the die from the predetermined area and causes the punch to rotate around the rotation axis in the first direction, wherein the punch holding portion holds the punch such that the punch does not make a revolution around the rotation axis as the punch holding portion is rotated from the predetermined area to punch a hole in a sheet by the punch and then returned to the predetermined area.

2. A sheet punching device according to claim 1, wherein the punch moving portion comprises:

an engaging and disengaging portion configured to engage the punch holding portion with the die during a period in which the die rotates within a predetermined rotation range, and to release an engagement of the punch holding portion and the die when the die rotates beyond the predetermined rotation range; and an elastic member configured to accumulate an elastic force during the period, and to rotate the punch holding portion to return to the predetermined area by the accumulated elastic force when the engagement is released.

3. A sheet punching device according to claim 1, wherein the punch moving portion comprises a fixed cam portion configured to move the punch in a direction of moving in and out of the die hole when the punch holding portion is rotated in synchronization with the die, wherein the fixed cam portion comprises a groove cam with which the punch is engaged, and wherein the groove cam is formed into an endless shape by connecting a first groove, which is configured to move the punch in a direction of moving in and out of the die hole, and a second groove, which is configured to locate the punch at the position separated from the die hole.

4. A sheet punching device according to claim 1, wherein the punch moving portion comprises a punch guide portion configured to guide the punch so that the punch moves in and out of the die hole, and wherein the punch guide portion serves as a sheet stripper configured to separate a sheet from the punch by receiving the sheet when the sheet in which the hole is punched by the punch is moved together with the punch in a direction of separating from the die hole.

5. A sheet punching device according to claim 1, wherein the punch is configured to be opposed to the die hole during a period in which the die rotates within a predetermined rotation range, and to punch the hole in the sheet, which is continuously conveyed.

6. A sheet punching device according to claim 1, wherein the die hole is formed in a flat part formed on an outer circumferential surface of the die.

7. A sheet punching device according to claim 1, wherein the die hole is formed in an arc part formed on an outer periphery of the die, the arc part having a curvature radius larger than a radius of the outer circumferential surface of the die.

8. An image forming apparatus, comprising:

an image forming unit configured to form an image on a sheet; and a sheet punching device according to claim 1, configured to punch a hole in the sheet.

9. A sheet punching device according to claim 1, wherein the punch moving portion is configured to locate the punch at a position separate from the die hole while the punch holding portion returns in the second direction to the predetermined area.

10. A sheet punching device according to claim 1, wherein the punch holding portion rotates in a reciprocating manner around the rotation axis.

11. A sheet punching device according to claim 1, wherein a rotation center of the punch holding portion is the rotation axis.

* * * * *